US005954331A

United States Patent [19]

Hepburn

[11] Patent Number: 5,954,331

[45] Date of Patent: Sep. 21, 1999

[54] METHOD FOR PLAYING FORTUNE TELLING GAME

[76] Inventor: Rae Hepburn, 253 S. Doheny Dr., Unit 2, Beverly Hills, Calif. 90211

[21] Appl. No.: 08/705,610

[22] Filed: Aug. 30, 1996

Related U.S. Application Data

[62] Division of application No. 08/548,946, Oct. 26, 1995, abandoned.

[51] Int. Cl.[6] ..... A63F 9/18

[52] U.S. Cl. ..... 273/161

[58] Field of Search ..... 273/161, 157 R, 273/153 R, 248, 249, 292, 429, 430

[56] References Cited

U.S. PATENT DOCUMENTS

| | | | |
|---|---|---|---|
| D. 269,921 | 8/1983 | Young, Jr. et al. | 273/161 |
| D. 270,461 | 9/1983 | Young, Jr. et al. | D21/813 |
| 1,016,142 | 1/1912 | Hanley | 273/161 |
| 1,139,356 | 5/1915 | Fields | 273/308 |
| 2,034,991 | 3/1936 | Salinger | 273/161 |
| 4,583,737 | 4/1986 | Falcone et al. | 273/161 |
| 4,779,870 | 10/1988 | Nichols | 273/161 |
| 5,599,020 | 2/1997 | Fields | 273/161 |

*Primary Examiner*—Steven Wong

[57] ABSTRACT

The present invention relates to fortune telling game which through intuitive and interpretive input of the player, is utilized to attain personal answers to his or her fortune for the future year, week, and/or answers to involving marriage, success, wealth, love, career and/or happiness. More particularly, the present invention relates to one player attaining these answers for another player. The present invention is directed to a fortune telling game which, through the intuitive and interpretive input of the player, can be used to attain personal answers to his or her fortune for the coming year, coming week or answers to questions. One player can also attain these answers for another player. The invention includes a deck of fortune telling cards alone or in a combination with two game board apparatus and also the methods of playing the game. The present invention includes a deck of fortune telling cards used for dividing the coming year or the coming week for the querist. The deck of fortune telling cards is also used for arriving at a response posed by a player to questions about marriage, success, wealth, love, career and happiness. The deck of cards is made up of a plurality of cards, each of which is round and has an indicia bearing face. The indicia may be a combination of at least one word, a symbol and a meaning for the symbol.

10 Claims, 29 Drawing Sheets

188--

--190

192--

--194

196--

--198

200--

--202

400

500

600

700

800

METHOD FOR PLAYING FORTUNE TELLING GAME

CROSS REFERENCE TO RELATED APPLICATIONS

This application is a divisional of U.S. application Ser. No. 08/548,946 filed Oct. 26, 1995, now abandoned.

FIELD OF THE INVENTION

The present invention relates to fortune telling game which through intuitive and interpretive input of the player, is utilized to attain personal answers to his or her fortune for the future year, week, and/or answers to involving marriage, success, wealth love, career and/or happiness. More particularly, the present invention relates to one player attaining these answers for another player.

DESCRIPTION OF THE PRIOR ART

Fortune telling using tea leaves is one of the earliest forms of geomancy, the art of divining fortunes from the patterns made by various objects. The Chinese believed that tea had not only medicinal qualities but also spiritual qualities and that the patterns formed by the leaves in a cup or bowl mirrored similar patterns that existed in the Astral. The meaning of these symbols were passed on through generations and were brought to Europe by the traders of old.

Numerous innovations for fortune telling games have been provided in the prior art that are described as follows. Even though these innovations may be suitable for the specific individual purposes to which they address, they differ from the present invention as hereinafter contrasted.

In U.S. Pat. No. 4,583,737 Titled, FORTUNE TELLING GAME AND DECK OF CARDS, invented by Falcone et al. comprises a deck of fortune telling cards for indicating a response to a query comprising a plurality of cards, each of said cards having a top and bottom end and a single indicia bearing face, the indicia of said indicia bearing face being oriented in a common direction from said top end to said bottom end, said indicia of each card comprising at least one word, symbol or combination thereof which bears a first suggestive relationship to said query when the card is oriented with the top end above the bottom end, and an opposite suggestive relationship to said query when said card is oriented with the top end below the bottom end; said plurality of cards comprising a first group of cards, each bearing indicia suggestive of a composite of at least one of a physical and personality characteristic of a person; and a second group of cards, each bearing indicia suggestive of a relationship to the indicia of each of said first group of cards or both. Also disclosed are methods of playing the fortune telling game and playing boards used in conjunction therewith.

The above described patented invention differs from the present invention because it has two game boards and the following:

I) has places marked for 3 question cards and 9 answer cards, and ii) is a modified version having spaces only for 2 questions cards and 5 answers cards.

The present invention has 2 boards and the following:

I) made up of 12 Month of the Year cards based on the Julian calendar, and ii) made up of 6 Astral House Question cards.

In addition, there are two groups of cards for U.S. Pat. No. 4,583,737 and the following differences:

I) based on the meanings of the Tarot cards which become the opposite when the card is reversed, and ii) based on numerology.

These two sets of cards are used in concert with one another.

In the present invention, the cards are taken solely from the geomantic symbols formed by tea leaves and the meanings of those symbols. The meanings do not change when the card is reversed.

There are:

A) 182 Tea Leaf Fortune symbol cards in my deck,

B) 12 Month of the Year cards, and

C) 6 Astral House Question cards.

When the cards are read in concert with one another the player has the ability to tell his fortune for the coming year or the coming week. The cards will also answer questions relating to the specific Astral House cards of Marriage, Success, Wealth, Love, Career and Happiness.

In U.S. Pat. No. 4,779,870, Titled, FORTUNE TELLING GAME, Invented by Daphne W. Nichols, comprises the fortune telling game of the present invention comprises a game board having top and bottom surfaces, the top surface being divided into twelve equal radial sectors. Each sector has an area embodying one of the twelve celestial or zodiac house signs, an area having displayed house identifying indicia, and an information area having displayed therein indica giving the characteristics of the zodiac house identified with the related zodiac house area. In combination with a game board is a deck or plurality of playing cards, each of the cards having a bottom surface and a top surface and a top indicia bearing surface. The indicia of each top surface comprises characteristics suggestive of a relationship to at least a portion of the indicia giving the characteristics of a zodiac house when oriented with a particular house sector. The plurality of cards comprises four groups of cards each group of cards bearing indicia of one standard card suit selected from the group consisting of hearts, clubs, spades and diamonds. Other non-suit cards are provided having lunar or solar symbols and having respectively characteristics which suggest mental feelings or attitudes. Also, disclosed are methods of playing the fortune telling game.

The above described patented invention differs from the present invention because the game board is divided into 12 Celestial or Zodiac house signs.

The present invention has 2 boards and the following:

I) made up of 12 Month of the Year cards based on the Julian calendar, and ii) made up of 6 Astral House Question cards.

In addition, the plurality of cards for the patented invention are based on the 52 playing card deck suits of hearts, clubs, spades and diamonds and the meanings associated with the various cards. There are also two non-suit cards, the sun card and the moon card.

The present invention has cards taken solely from the geomantic symbols formed by tea leaves and the meanings of those symbols. There are 182 Tea Leaf Fortune Symbol cards in my deck, 12 Month of the Year cards and 6 Astral House Question cards.

When the cards of the present invention are read in concert with one another the player has the ability to tell his fortune for the coming year or the coming week. The cards will also answer questions relating to the specific Astral House cards of Marriage, Success, Wealth, Love, Career and Happiness.

In U.S. Pat. No. Des. 270,461, Titled, Board For Use With Fortune Telling Cards, invented by Robert W. Young, Jr., comprises an ornamental design for a board for use with fortune telling cards, as shown and described.

The above described patented invention differs from the above presented invention because: it is a game board with various design markings and places where four cards can be placed.

The present invention has 2 boards:

i) made up of 12 Month of the Year cards based on the Julian calendar, and ii) made up of 6 Astral House Question cards.

In U.S. Pat. No. Des 269,921, Tided, Deck of Fortune Telling Cards, invented by, Robert W. Young, Jr., comprises an ornamental design for a deck of fortune telling cards, as shown and described.

The above described patented invention differs from the above presented invention because: the plurality of cards are based on the meanings associated with the cards seven, eight, nine, ten, Jack, Queen, King and Ace of the four suits; hearts, clubs, diamonds, spades of a playing card deck. There are 32 cards in this deck.

The cards of the present invention are taken solely from the geomantic symbols formed by tea leaves and the meanings of those symbols. There are 182 Tea Leaf Fortune symbol cards in my deck, 12 Month of the Year cards, and 6 Astral House Question Cards.

When the cards of the present invention are read in concert with one another the player has the ability to tell his fortune for the coming year or the coming week. The cards of the present invention will also answer questions relating to the specific Astral House cards of Marriage, Success, Wealth, Love, Career, and Happiness.

Numerous innovations for fortune telling games have been provided in the prior art that are adapted to be used. Even though these innovations may be suitable for the specific individual purposes to which they address, they would not be suitable for the purposes of the present invention as heretofore described.

SUMMARY OF THE INVENTION

The present invention is directed to a fortune telling game which, through the intuitive and interpretive input of the player, can be used to attain personal answers to his or her fortune for the coming year, coming week or answers to questions involving marriage, success, wealth, love, career or happiness. One player can also attain these answers for another player. The invention includes a deck of fortune telling cards alone or in a combination with two game board apparatus and also the methods of playing the game.

The present invention includes a deck of fortune telling cards used for divining the coming year or the coming week for the querist. The deck of fortune telling cards is also used for arriving at a response posed by a player to questions about marriage, success, wealth, love, career and happiness. The deck of cards is made up of a plurality of cards, each of which is round and has an indicia bearing face. The opposite face may, for example, have decorative work thereon. The indicia of the indicia bearing face is oriented in a common direction. The indicia may be a combination of at least one word, a symbol and a meaning for the symbol. The suggestive relationship of the cards is personal to the player and may be interpreted in different ways by different players.

The present invention includes two game boards:

1. Twelve cards representing the months of the Julian calendar. Each of the cards is round and has an indicia bearing face. The opposite face may, for example, have decorative work thereon.
2. Six cards representing the Astral Houses of Marriage, Success, Wealth, Love, Career, Happiness. Each of the cards is round and has an indicia bearing face. The opposite face may, for example, have decorative work thereon.

The present invention includes an oversize teacup with a lid, both bearing decorative design on the exterior, which serves as a container for the game.

The types of problems encountered in the prior art is the querist accurately predicting future and/or current events. Unless the querist has studied the meanings of the standard playing cards or Tarot cards, the querist must rely on the interpretation of the diviner of either the standard playing cards or the Tarot cards.

If the querist is unaware of the meanings of these cards the diviner can interpret the cards as he or she chooses without necessarily revealing the accurate meanings of the cards.

In the prior art, unsuccessful attempts to solve this problem were attempted. However, the problem was solved by the present invention because a combination of astral, tea leaf fortune cards and month cards with the meanings clearly indicated were utilized facilitating fortune telling by the user.

Innovations within the prior art are rapidly being exploited in the field of attempting to predict future events.

The present invention went contrary to the teaching of the art which only utilizes a single deck of fortune telling cards.

The present invention solved a long felt need for user's to predict future and current events in their lives.

The present invention produced unexpected results namely: by utilizing different methods of the game, monthly, yearly, weekly and current events can be predicted.

A synergistic effect was produced utilizing he present invention due to the following facts and results from experimentation between the astral cards, tea leaf cards and/or the Julian month cards.

The novel features which are considered characteristic for the invention are set forth in the appended claims. The invention itself however, both as to its construction and its method of operation, together with additional objects and advantages thereof, will be best understood from the following description of the specific embodiments when read and understood in connection with the accompanying drawings.

BRIEF LIST OF REFERENCE NUMERALS UTILIZED IN THE DRAWING

| TEA LEAF FORTUNE CARDS-10 | PREDICTION |
|---|---|
| 12-ANGEL | Representing spiritual guidance. Protection from harm. |
| 14-ANT | Representing work, achievement, success. |
| 16-APPLE | Representing temptation will test you. |
| 18-ARCHWAY | Representing new opportunities, possibilities, paths opening up. |

-continued

| TEA LEAF FORTUNE CARDS-10 | PREDICTION |
|---|---|
| 20-ARROW | Representing you are on the right path regarding some aspect of your life. |
| 22-AX | Representing forces working against you. |
| 24-BAG | Representing something important like a new job or a raise. |
| 26-BARREL | Representing you feel something is lacking in your life. Could be love, money, goals. |
| 28-BASKET | Representing recognition. Reward for merit. |
| 30-BAT | Representing take care - enemies are working against you. |
| 32-BEAR | Representing danger, especially in a money matter. |
| 34-BEETLE | Representing good fortune. |
| 36-BELL | Representing announcement. |
| 38-BIRD-FLYING | Representing news is on the way. |
| 40-BIRD-PERCHED | Representing waiting for news, package, letter. |
| 42-BOAT | Representing money or property through an inheritance, winnings or windfall. |
| 44-BOOT | Representing increase your efforts if you want to achieve your goals. |
| 46-BOUQUET | Representing compliments from an admirer. |
| 48-BOW | Representing you are highly thought of |
| 50-BOWL | Representing plenty of material things. |
| 52-BOX | Representing you will receive a gift. |
| 54-BREAD | Representing period of prosperity and plenty. |
| 56-BRIDGE | Representing successfully overcoming a problem. |
| 58-BROKEN BRIDGE | Representing unsuccessful outcome to a problem. |
| 60-BROKEN RING | Representing parting of the ways in either romance or business. |
| 62-BROKEN WISHBONE | Representing wish will not be granted. |
| 64-BROOM | Representing new home. |
| 66-BULL | Representing do not back down from opposition. Show strength and fortitude. |
| 68-BUTTERFLY | Representing a change for the better. |
| 70-CAMEL | Representing persevere and you will overcome problems. |
| 72-CANDLE | Representing you will be shown the way. |
| 74-CANE | Representing pay attention to your health. |
| 76-CARRIAGE | Representing a journey either physically or mentally. |
| 78-CARROT | Representing opportunity or windfall. |
| 80-CASKET | Representing someone going out of your life or the end of a situation. |
| 82-CAT | Representing a two-faced friend. |
| 84-CATERPILLAR | Representing someone is jealous of you. |
| 86-CHAIN | Representing chain of events that will affect your life. |
| 88-CHAIR-FILLED | Representing someone new is entering your life. |
| 90-CLAW | Representing be careful-do not take risks. |
| 92-CLOUDS | Representing temporary problems. |
| 94-CLUB | Representing someone will try to make you do something against your will. |
| 96-COBWEB | Representing protected from negative forces beyond your control. |
| 98-COINS | Representing money will be coming to you. |
| 100-CRACKED CUP | Representing dissatisfaction with life. |
| 102-CRIB | Representing birth or conception of a child or enterprise. |
| 104-CROWN | Representing honor and respect will come to you. |
| 106-CUP | Representing that you should accept valid criticism. |
| 108-DAGGER | Representing fear, worries, tense situations. |
| 110-DARK MAN | Representing dealings or relationship with a man with dark complexion or hair. |
| 112-DARK WOMAN | Representing dealings or relationship with a woman with dark complexion or hair. |
| 114-DESK | Representing pay attention to your work. |
| 116-DIAMOND | Representing gift of jewelry. |
| 118-DOG | Representing protection from a powerful friend. |
| 120-DOGS | Representing getting together with friends. |
| 122-DOG-BARKING | Representing advice from a friend. |
| 124-DOG-CLOSE UP | Representing pleasure with a close friend. |
| 126-DOG-FAR AWAY | Representing a distant friend is thinkg about you. |
| 128-DOLPHIN | Representing financial gain. Usually coming from something you did in the past. |
| 130-DOOR | Representing opportunities are awaiting you. |
| 132-DRAGON | Representing beware of self-delusion. |
| 134-EAGLE | Representing triumph over troubles, obstacles. |

-continued

| TEA LEAF FORTUNE CARDS-10 | PREDICTION |
|---|---|
| 136-EAR | Representing good news. |
| 138-EGG | Representing success assured with good plans and hard work. |
| 140-ELEPHANT | Representing long journey either physically or mentally. |
| 142-EMPTY CHAIR | Representing someone leaving your life. |
| 144-EYE | Representing psychic ability. |
| 146-FAIR MAN | Representing dealings or relationship with a man with light complexion or hair. |
| 148-FAIR WOMAN | Representing dealings or relationship with a woman with light complexion or hair. |
| 150-FAN | Representing romance, celebration, party. |
| 152-FEATHER | Representing someone you know is undependable, insincere. |
| 154-FINGER | Representing warning you of a problem either now or in the near future. |
| 156-FIRE | Representing strong emotion. Passionate love or hate. |
| 158-FIRECRACKER | Representing excitement. |
| 160-FLAG | Representing do not be tempted to lower your standards. |
| 162-FLOWERS | Representing happiness. |
| 164-FLUTE | Representing disappointment in a friend or lover. |
| 166-FLY | Representing a period of ill health. |
| 168-FOREST | Representing muddled, unclear thinking. |
| 170-FOUR LEAF CLOVER | Representing great good fortune. |
| 172-FOX | Representing shrewdness and resourcefulness especially in business. |
| 174-FRYING PAN | Representing trouble, accusations. |
| 176-FUNNEL | Representing period of frustration. Lessons to be learned. |
| 178-GAVEL | Representing involvement with the law. |
| 180-GOLDFISH | Representing increase in material wealth or spiritual growth. |
| 182-GONG | Representing an exciting event. |
| 184-GRAPES | Representing time to go out and have fun. |
| 186-GRASSHOPPER | Representing situations in the balance that require careful handling. |
| 188-HAMMOCK | Representing taking a vacation, physically or mentally. |
| 190-HAND | Representing in need of help, assistance, guidance. |
| 192-HANDSHAKE | Representing a meeting with a stranger. could be important. |
| 194-HARP | Representing great happiness. |
| 196-HAT | Representing you will be playing a different role. |
| 198-HAYSTACK | Representing karma- you will reap what you have sown. |
| 200-HEART | Representing love, deep affection, caring. |
| 202-HILLS | Representing obstacles to overcome. |
| 204-HORSE | Representing short journey. |
| 206-HORSESHOE | Representing good luck. |
| 208-INKPOT | Representing problems to be resolved. |
| 210-JUG | Representing lighthearted, carefree time. |
| 212-KANGAROO | Representing unsettled times. Need to plan ahead. |
| 214-KEY | Representing successful outcome to problems. |
| 216-KITE | Representing vacation. |
| 218-KNOT | Representing unsuccessful plans. |
| 220-LADDER | Representing climbing toward success. |
| 222-LEG | Representing stepping into a new experience. |
| 224-LIGHTNING | Representing control your anger or you will be sorry. |
| 226-LILY | Representing spiritual love. |
| 228-LION | Representing time to act. |
| 230-LOBSTER | Representing financial pinch. |
| 232-MAN | Representing dealings or relationship with a man. |
| 234-MICE | Representing discord among friends or family. |
| 236-MONEY PATH | Representing a path with money is waiting for you to find it. |
| 238-MOON | Representing changes in your life. |
| 240-MOUNTAIN | Representing major challenge to overcome. |
| 242-MOUNTAIN ROAD | Representing you are on the road to success. |
| 244-MULE | Representing someone is extremely stubborn and unwilling to change. |

-continued

| TEA LEAF FORTUNE CARDS-10 | PREDICTION |
|---|---|
| 246-NEEDLE & THREAD | Representing a sincere wish will be granted. |
| 248-NEST | Representing emotionally secure, loving family. |
| 250-OLDER MAN | Representing dealings or relationship with an older man. |
| 252-OLDER WOMAN | Representing dealings or relationship with an older woman. |
| 254-OWL | Representing good advice from a wise person. |
| 256-PAIL | Representing time to get out of a situation. |
| 258-PARROT | Representing someone will gossip about all your secrets. |
| 260-PEACOCK | Representing beware of great pride. |
| 262-PIG | Representing beware of greed. |
| 264-PIN | Representing new job, career. |
| 266-PINEAPPLE | Representing reconciliation. |
| 268-PURSE | Representing pay attention to your finances. |
| 270-QUILL | Representing get back to the basics. |
| 272-RABBIT | Representing too much concern with sexual matters. |
| 274-RAINBOW | Representing the most difficult part of a situation is over. |
| 276-RAM | Representing a stubborn, aggressive person. |
| 278-RAT | Representing someone working against you behind your back. |
| 280-RING | Representing a marriage will take place, either romantic or business. |
| 282-ROOSTER | Representing an arrogant, boastful person you should not cross. |
| 284-ROSE | Representing romance is in the air. |
| 286-SCALES | Representing keep your life in balance. |
| 288-SCISSORS | Representing disappointment in some affair. |
| 290-SEA HORSE | Representing family matters. |
| 292-SHARK | Representing take care or there will be a loss of material wealth. |
| 294-SHIELD | Representing you need to defend yourself |
| 296-SKULL | Representing hidden secrets can harm you |
| 298-SPEAR | Representing heartache over what you no longer have. |
| 300-STAFF | Representing you will be taken care of in difficult times. |
| 302-STAR | Representing guaranteed success. |
| 304-STORK | Representing news of a birth or a new business opportunity. |
| 306-SUN | Representing happiness and well being. |
| 308-SUNRISE | Representing new creative ideas. New ventures. A fresh start. |
| 310-TABLE | Representing favorable period for you. |
| 312-TANKARD | Representing celebration, fun, enjoyment. |
| 314-TARGET | Representing goal oriented person. |
| 316-TEAPOT | Representing deep friendship with someone of the same sex. |
| 318-TEARDROPS | Representing great personal sorrow. |
| 320-TENT | Representing temporary situation. |
| 322-THRONE | Representing position of authority. |
| 324-TIGER | Representing doing something risky. Taking a chance. |
| 326-TORCH | Representing spiritual development, great enlightenment, awareness, understanding. |
| 328-TORTOISE | Representing slowly but surely getting ahead. |
| 330-TOWER | Representing solid foundation. Success with effort. |
| 332-TREE | Representing affairs with your family. |
| 334-TULIP | Representing great passion. |
| 336-TURKEY | Representing someone is behaving stupidly. |
| 338-UNICORN | Representing use your intuition to make beneficial changes. |
| 340-V | Representing victory in some endeavor. |
| 342-VALLEY | Representing deep personal strength and peace that assure success. |
| 344-VASE | Representing secret admirer. |
| 346-VINE | Representing you must seek out information that will help you. |
| 348-VULTURE | Representing beware of a person who wants something you have. |
| 350-WALL | Representing misunderstanding. |
| 352-WEDGE | Representing someone is trying to come between you and a friend or something you want. |
| 354-WEEPING WILLOW | Representing family sorrow. |

-continued

| TEA LEAF FORTUNE CARDS-10 | PREDICTION |
|---|---|
| 356-WELL | Representing family wishes come true. |
| 358-WHALE | Representing great worry over nothing. |
| 360-WHEEL | Representing indecisiveness. Allowing your life to flow instead of taking charge. |
| 362-WINDCHIMES | Representing peace and harmony. |
| 364-WISHBONE | Representing a wish is granted. |
| 366-WOMAN | Representing dealings or a relationship with a woman. |
| 368-WREATH | Representing sorrow over a loss. |
| 370-YOKE | Representing feeling tied down, frustrated. |
| 372-YOUNGER MAN | Representing dealings or relationship with a younger man. |
| 374-YOUNGER WOMAN | Representing dealings or relationship with a younger woman. |
| JULIAN MONTH CARDS - 400 | |
| 402-JANUARY | |
| 404-FEBRUARY | |
| 406-MARCH | |
| 408-APRIL | |
| 410-MAY | |
| 412-JUNE | |
| 414-JULY | |
| 416-AUGUST | |
| 418-SEPTEMBER | |
| 420-OCTOBER | |
| 422-NOVEMBER | |
| 424-DECEMBER | |
| ASTRAL HOUSE CARDS - 500 | |
| 502-MARRIAGE | |
| 504-SUCCESS | |
| 506-WEALTH | |
| 503-LOVE | |
| 510-CAREER | |
| 512-HAPPINESS | |

BRIEF DESCRIPTION OF THE PREFERRED EMBODIMENT

DETAILED DESCRIPTION OF THE PREFERRED EMBODIMENT

Figure 4:
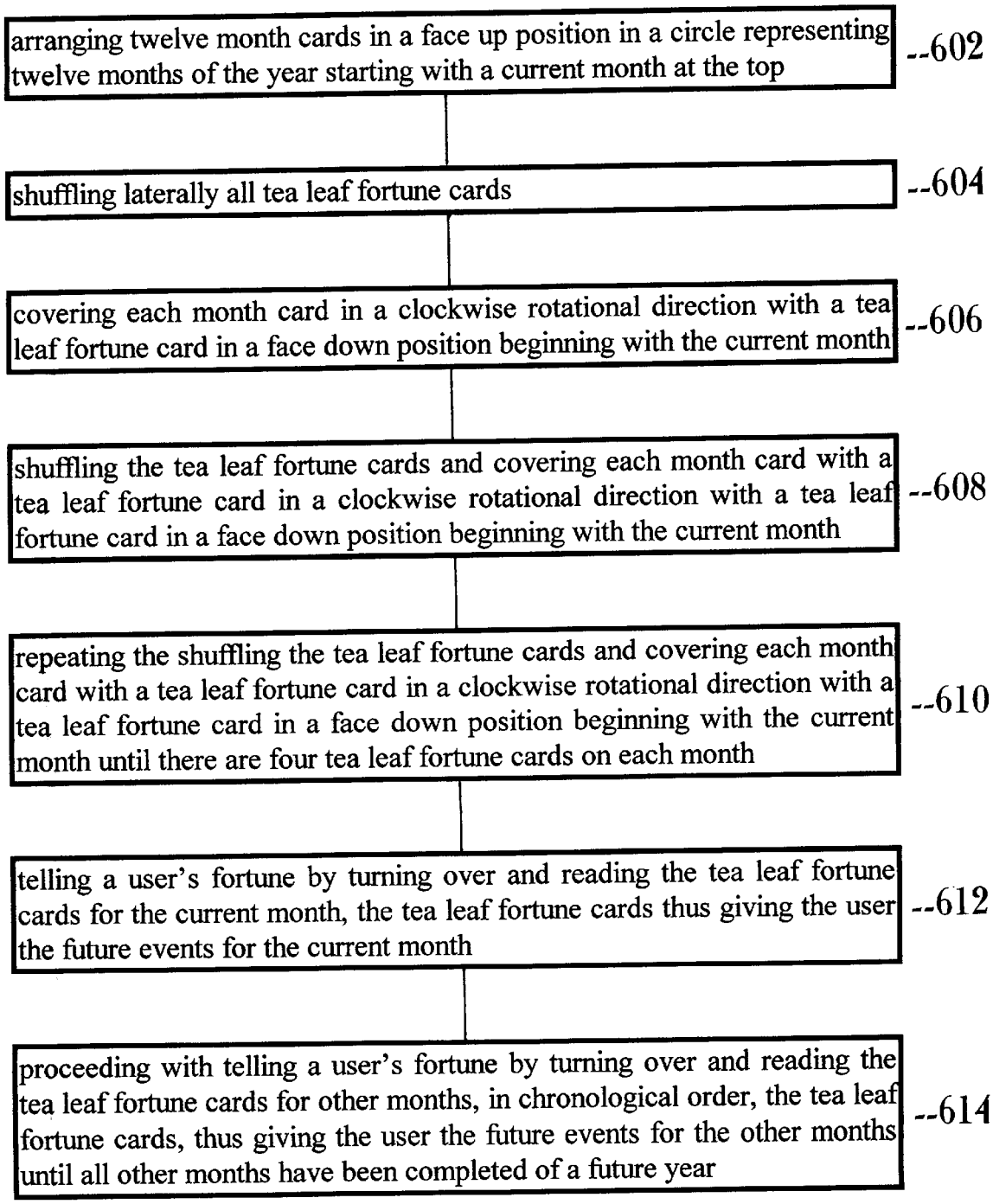
FIG. 4 is a diagrammatic view of a method of predicting a future for an upcoming year.

Referring to FIG. 4 which is a diagrammatic view of a method of predicting a future for an upcoming year 600 exhibiting the following steps: arranging twelve cards in a face up position in a circle representing the twelve Julian calendar months of the year starting with a current month at the top 602; shuffling laterally all tea leaf fortune cards 604; covering each month card in a clockwise rotational direction with a teal leaf fortune card in a face down position beginning with the current month 606; shuffling the tea leaf fortune cards and covering each month card with a tea leaf fortune card in a clockwise rotational direction with a tea leaf fortune card in a face down position beginning with the current month 608; repeating the shuffling the tea leaf fortune cards and covering each month card with a tea leaf fortune card in a clockwise rotational direction with a tea leaf fortune card in a face down position beginning with the current month until there are four tea leaf fortune cards on each month 610; telling a user's fortune by turning over and reading the tea leaf fortune cards for the current month, the tea leaf fortune cards, thus giving the user the future events for the current month 612; and proceeding with telling a user's fortune by turning over and reading the tea leaf fortune cards for other months, the tea leaf fortune cards, thus giving the user the future events for the other months until all other months have been completed of a future year 614. This method predicts the future about the current month and the upcoming year. This method should always be used first when a user is using the cards for the very first time. Preferably, the user should use this method every three months but certainly not more frequently than once a month as a user's long term energy needs time to reflect the changes before future predictions can be told to the user by utilizing the cards.

Figure 1:
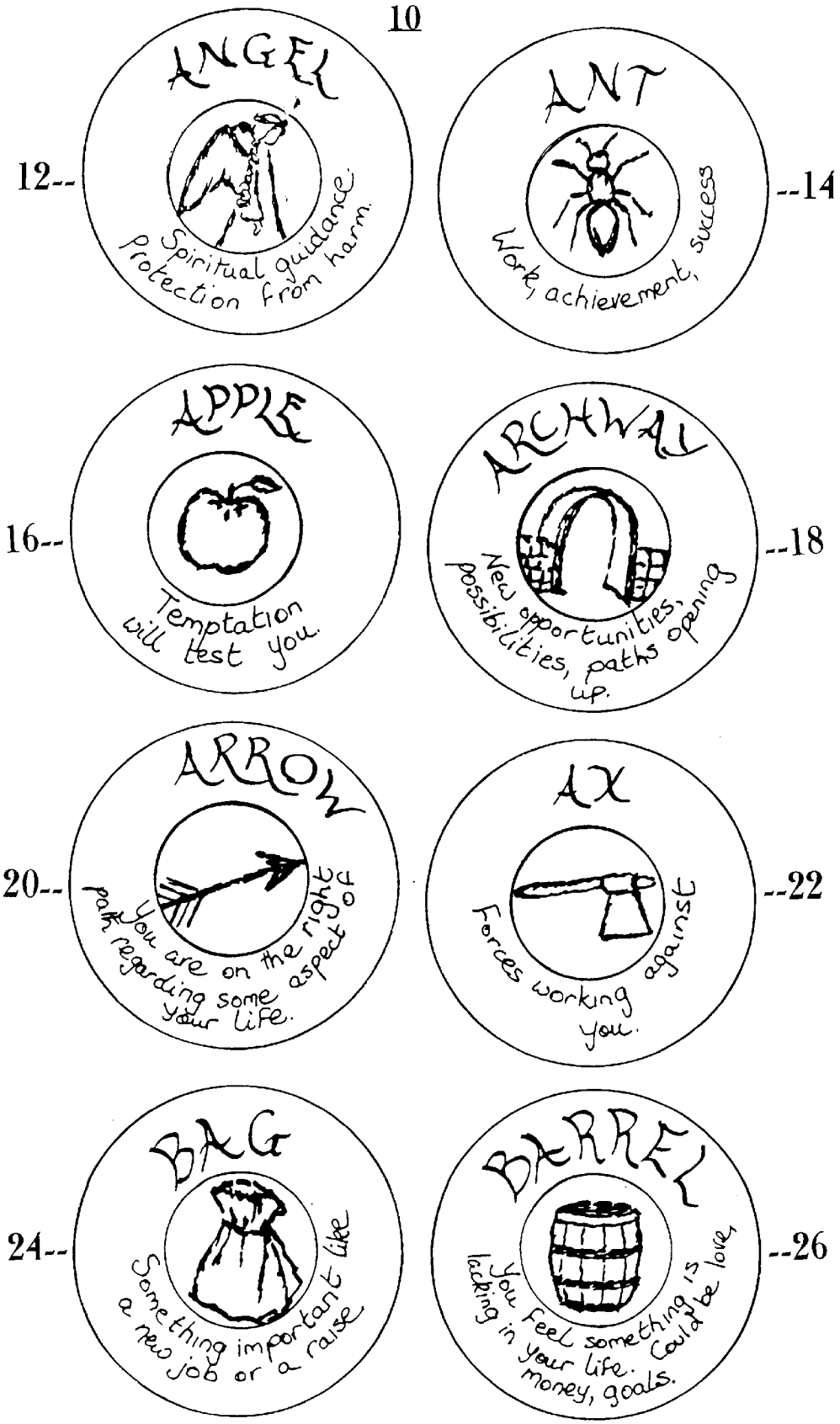
FIG. 1 are top views of tea leaf fortune cards with corresponding predictions.
Figure 1:
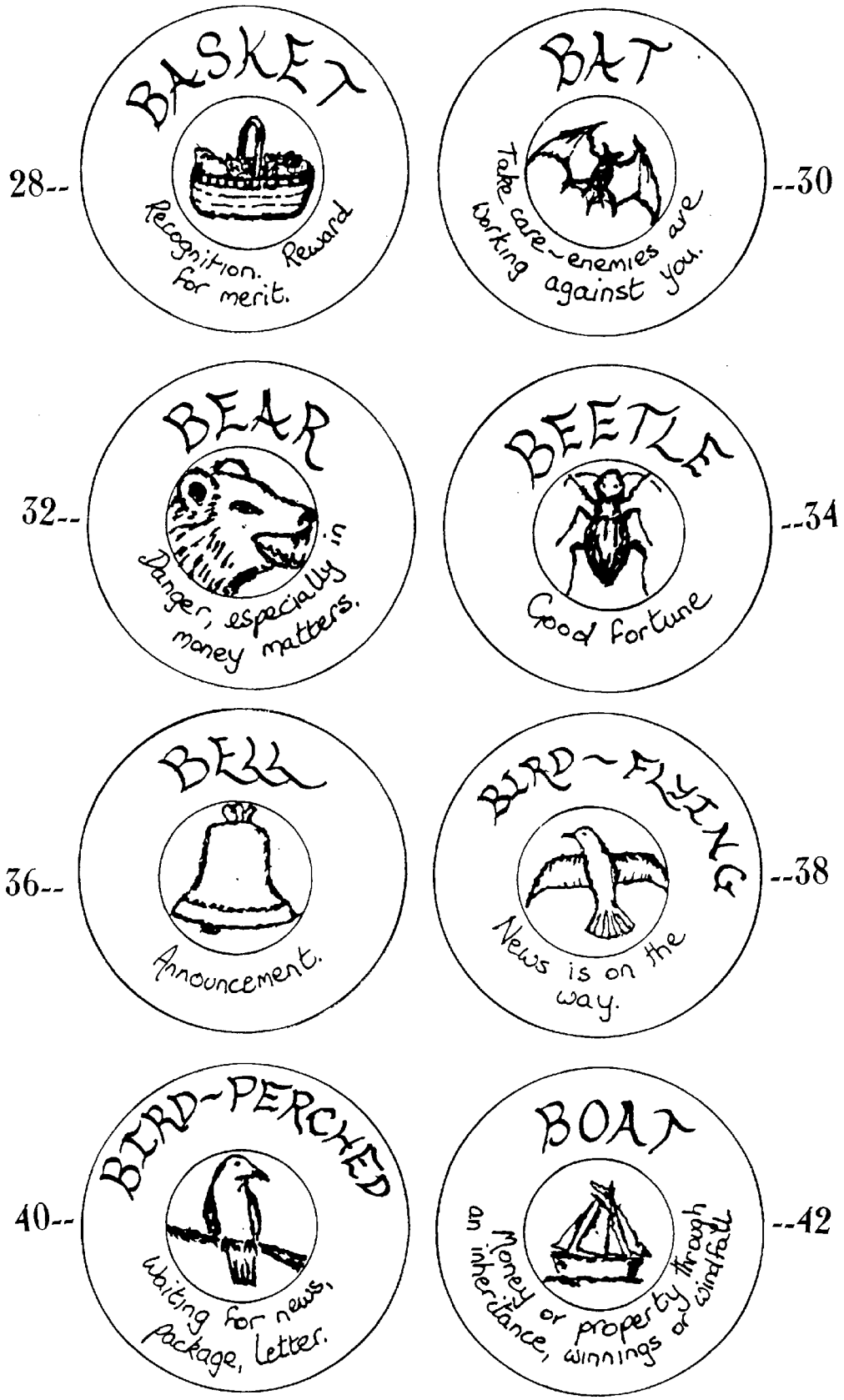
Figure 1:
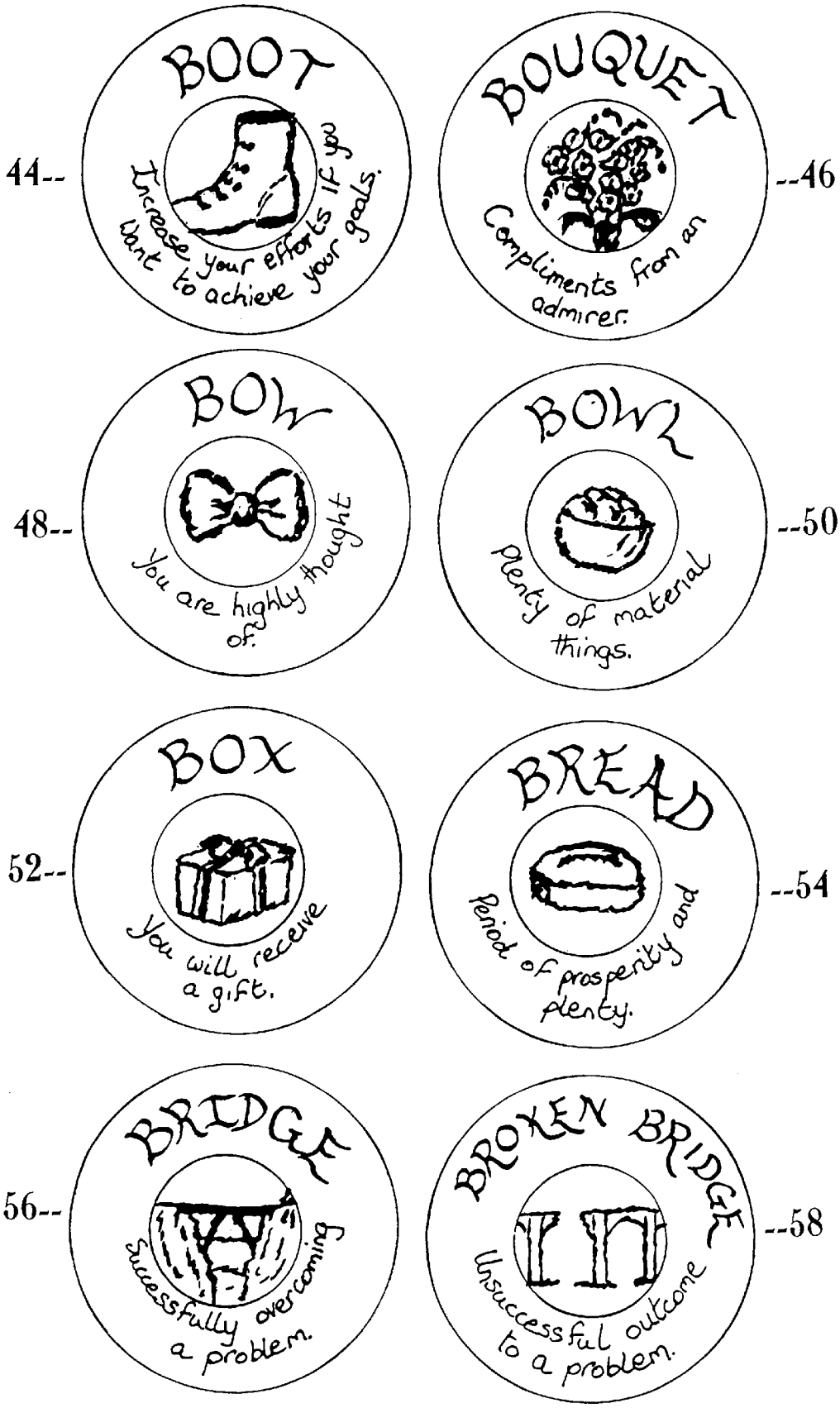
Figure 1:
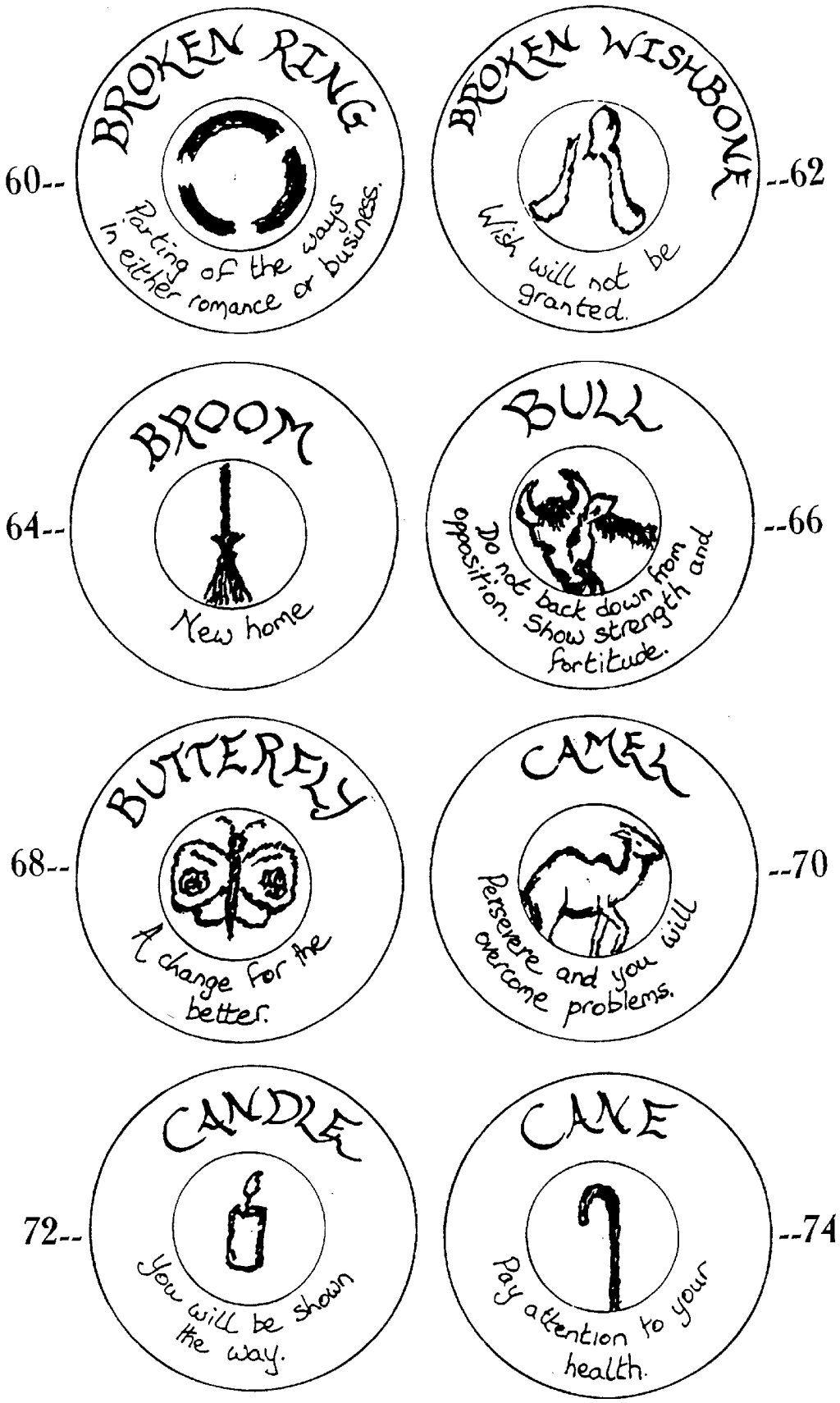
Figure 1:
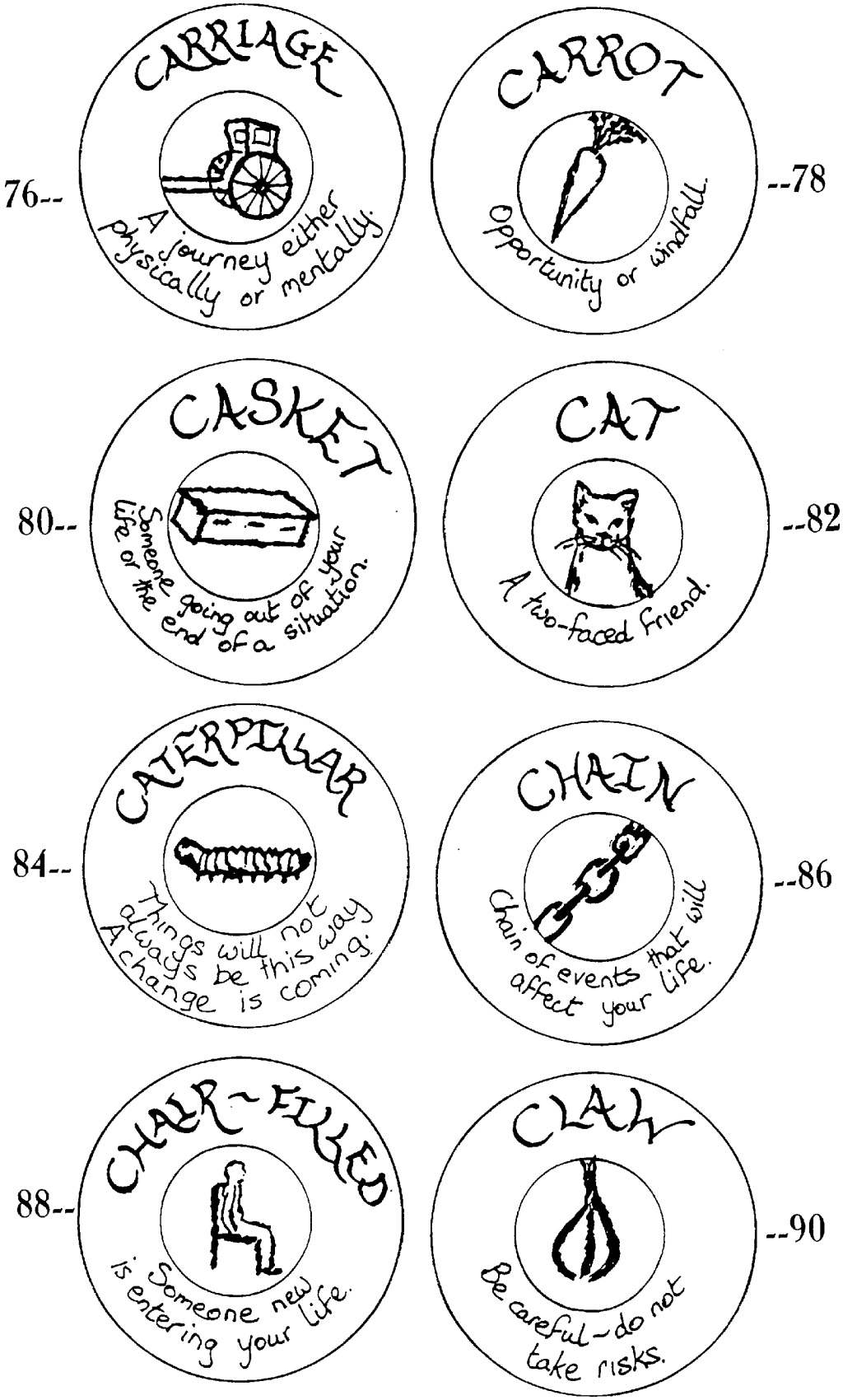
Figure 1:
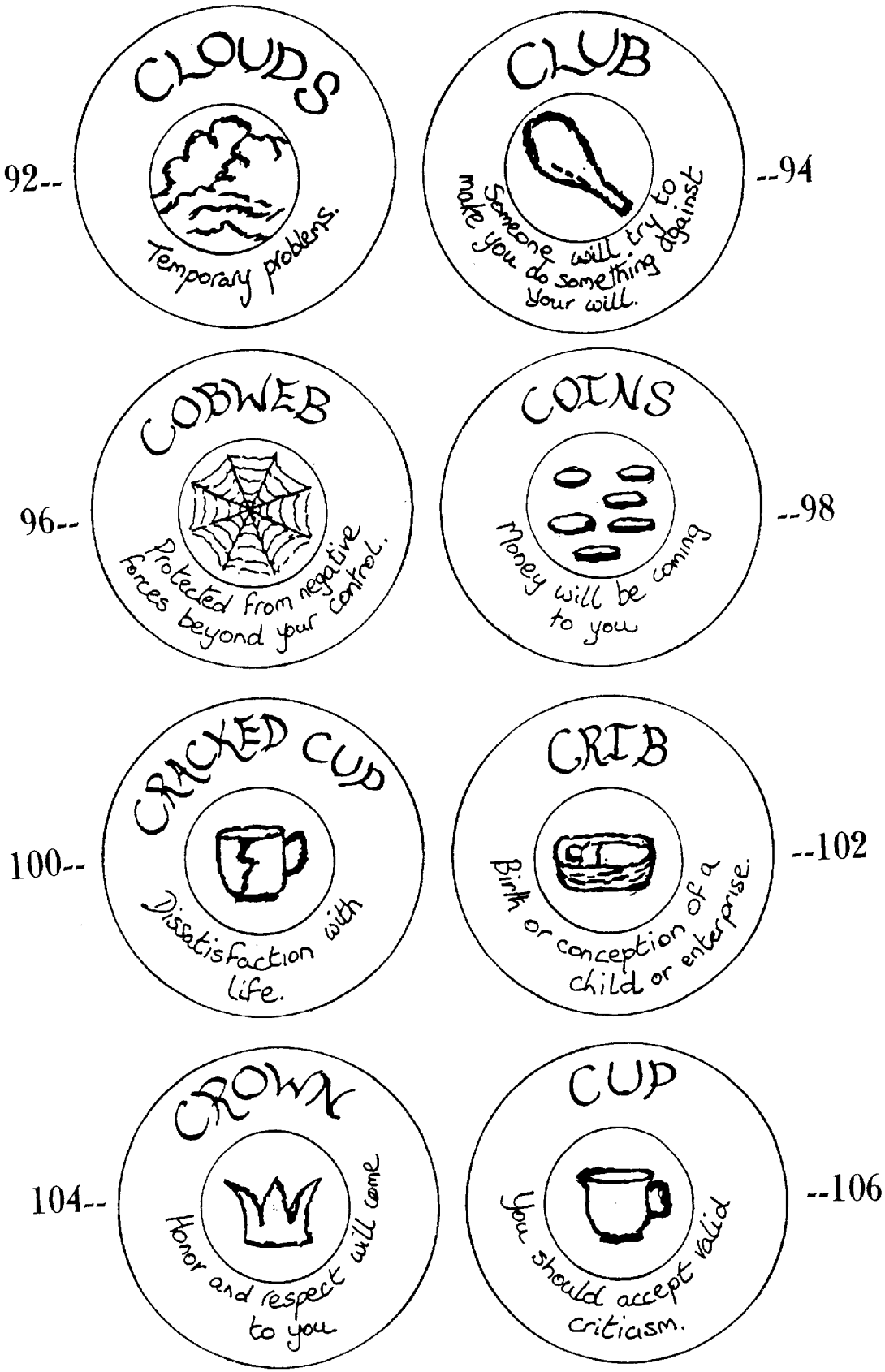
Figure 1:
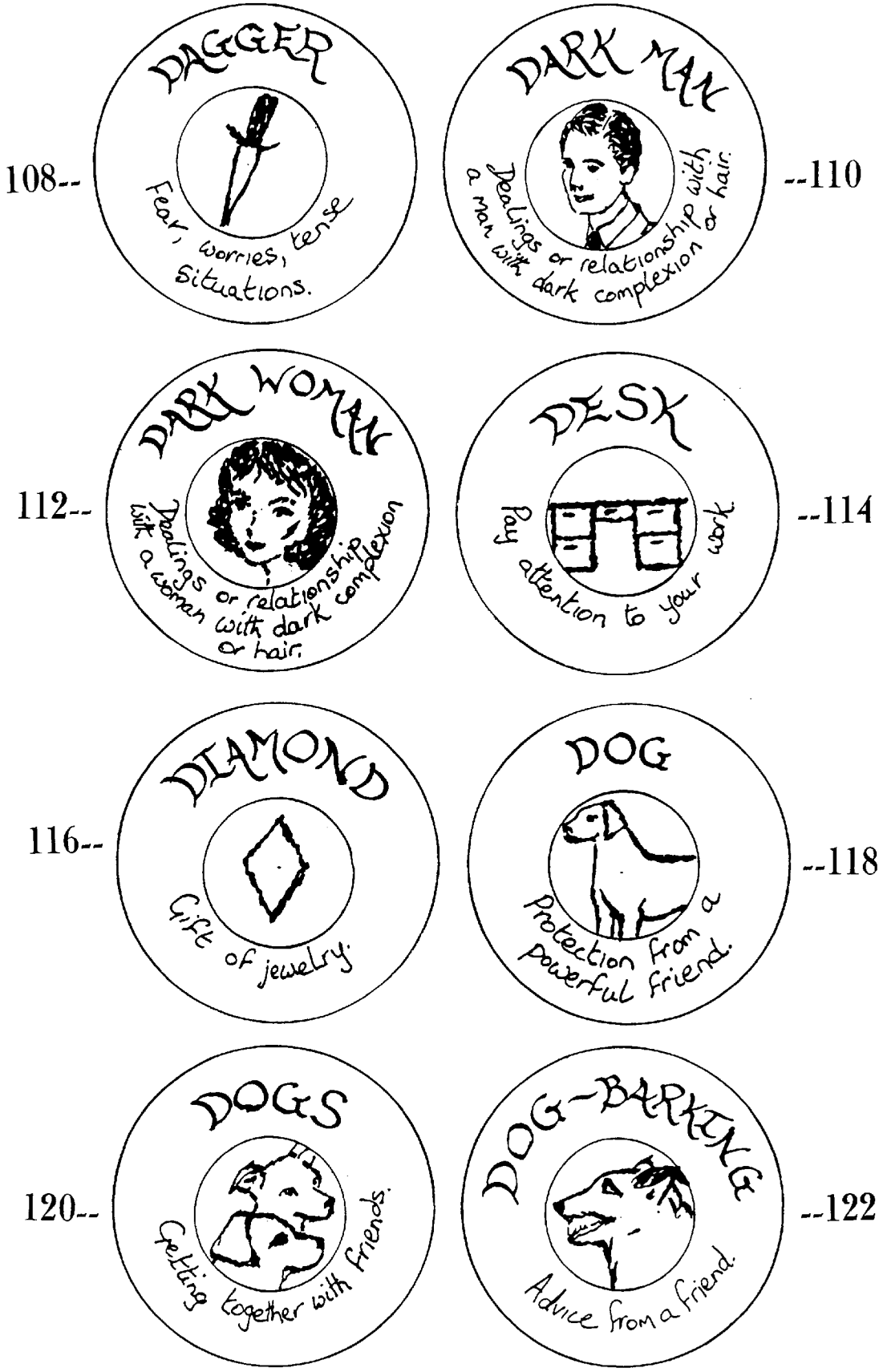
Figure 1:
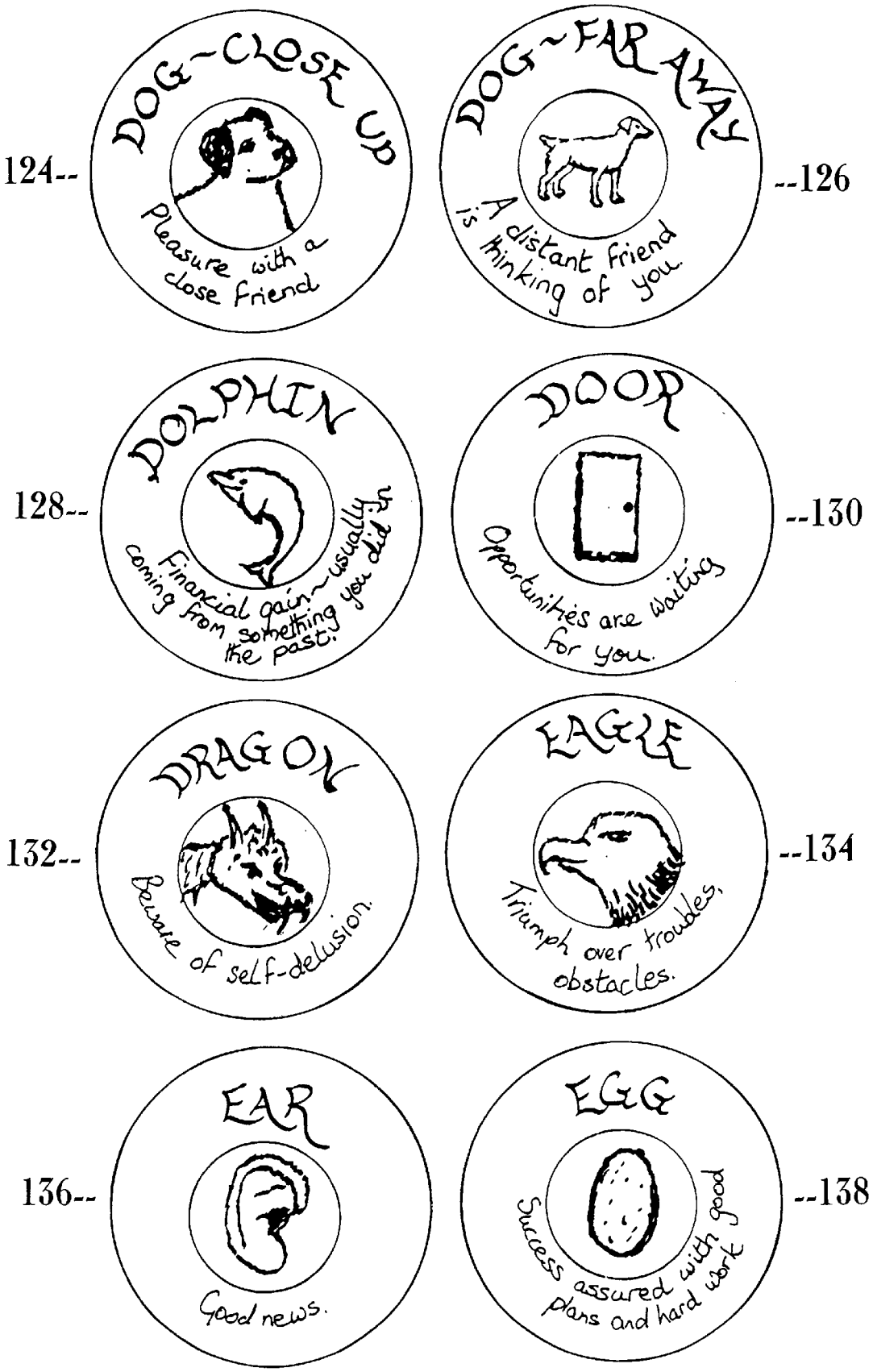
Figure 1:
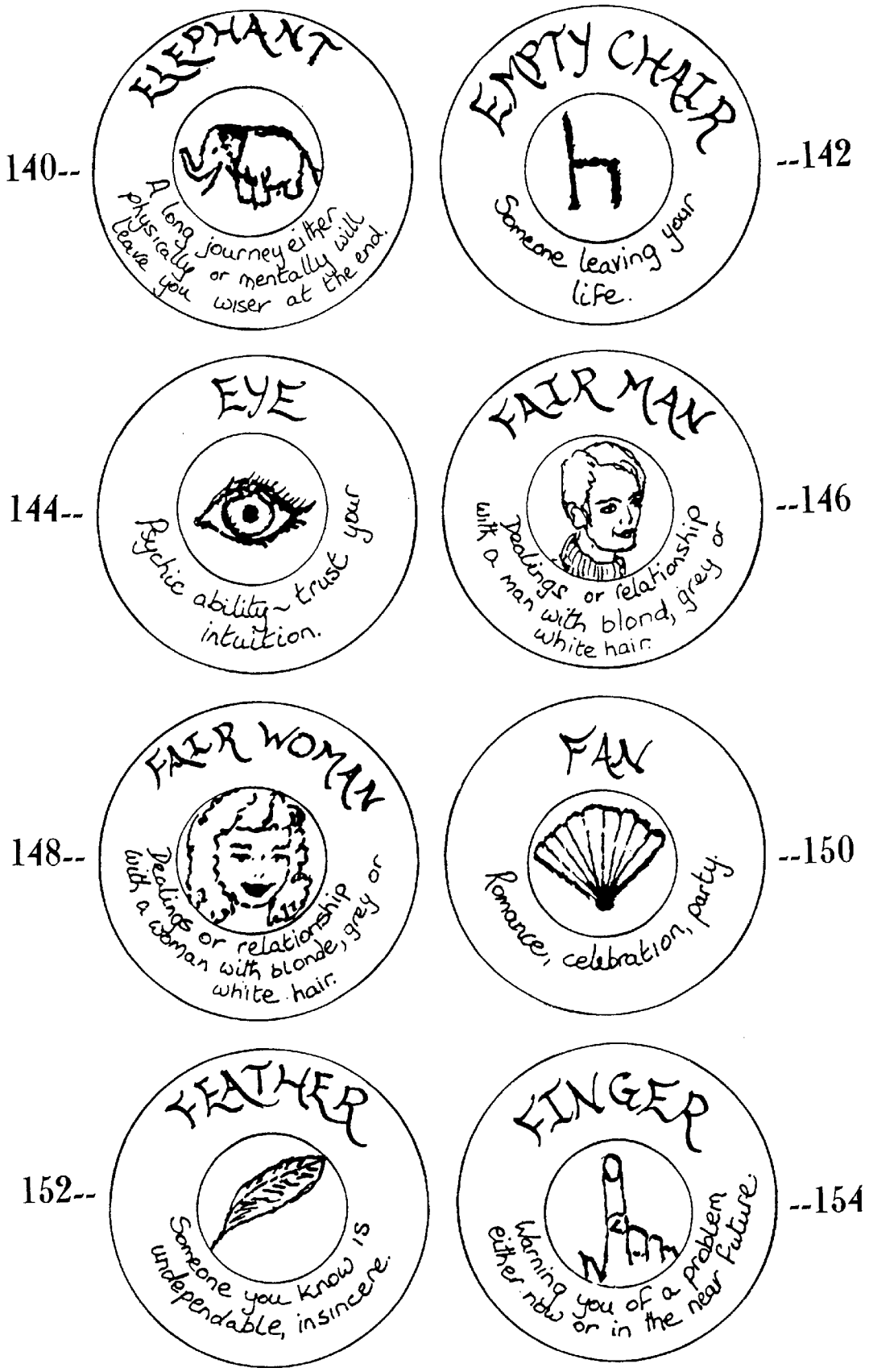
Figure 1:
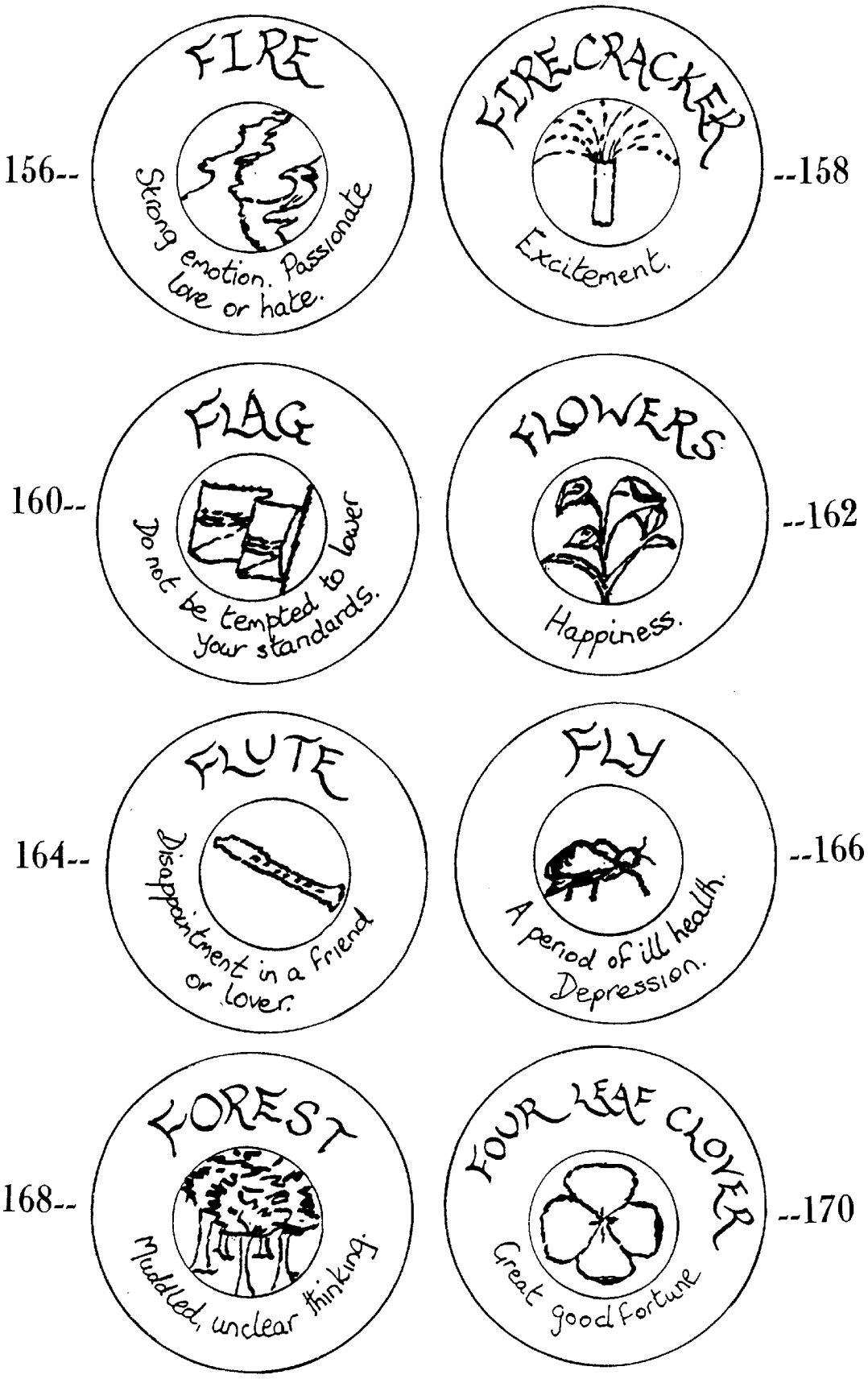
Figure 1:
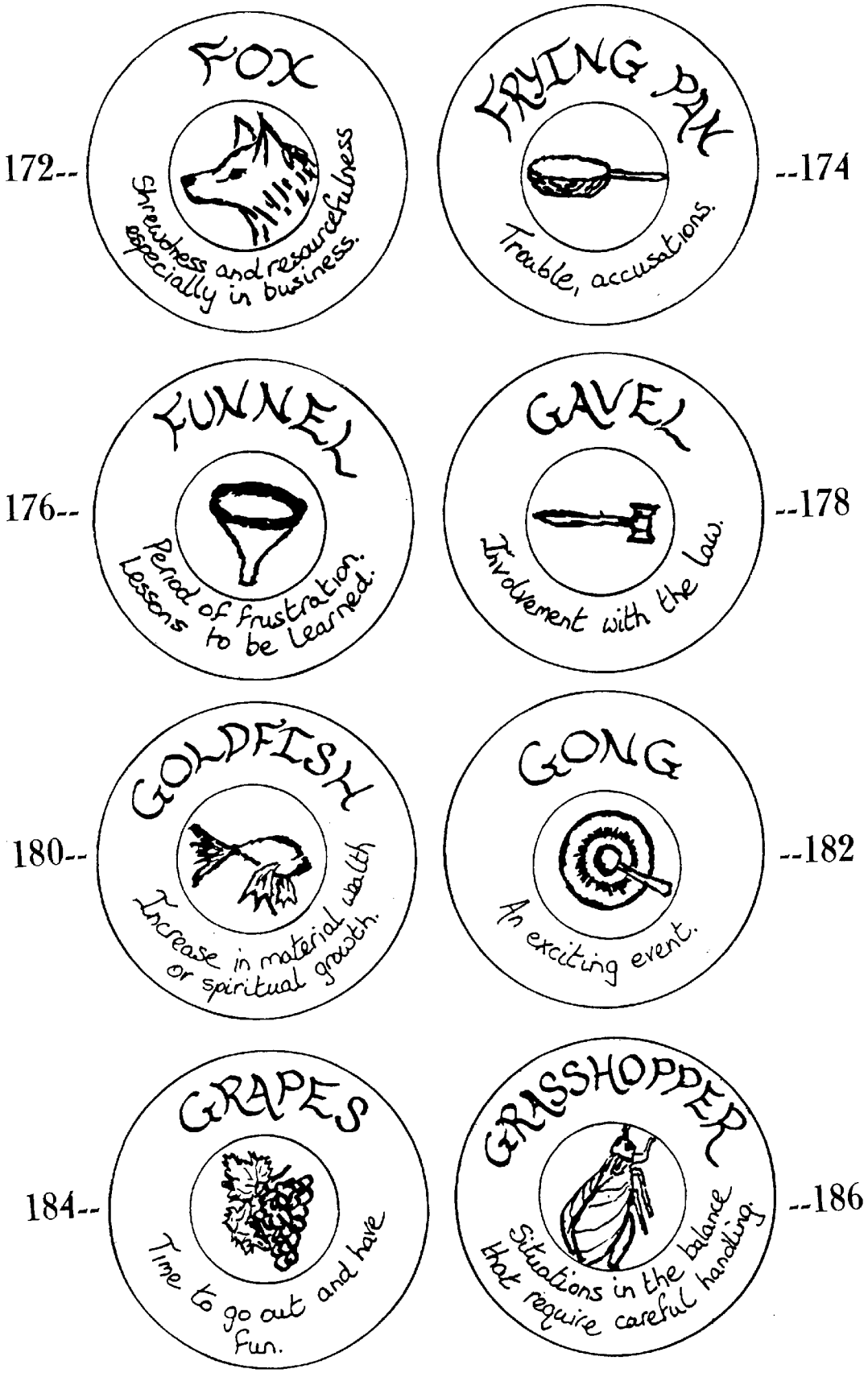
Figure 1:
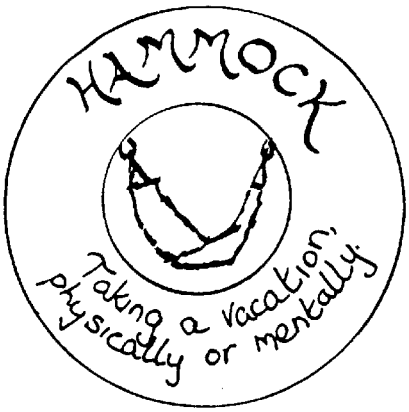
Figure 1:
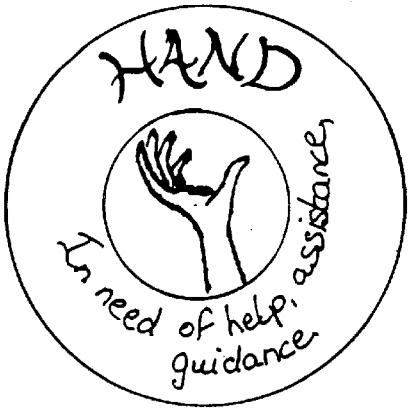
Figure 1:
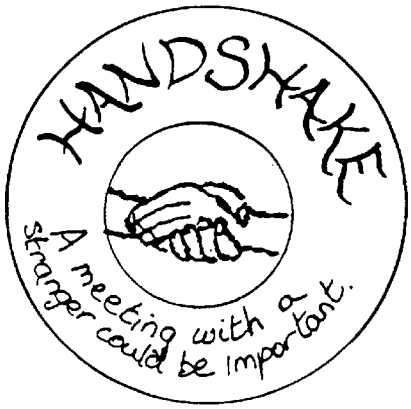
Figure 1:
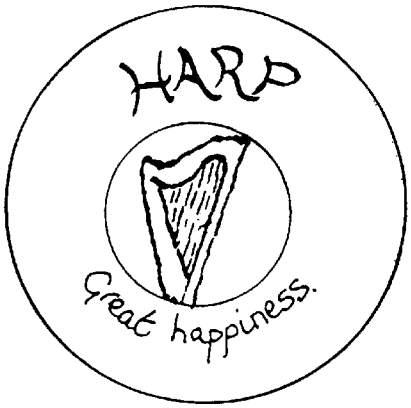
Figure 1:
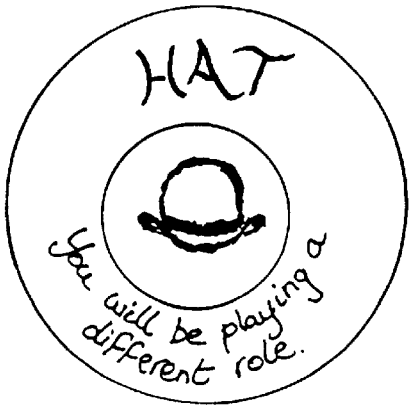
Figure 1:
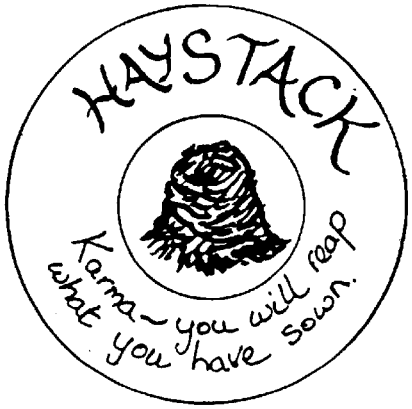
Figure 1:
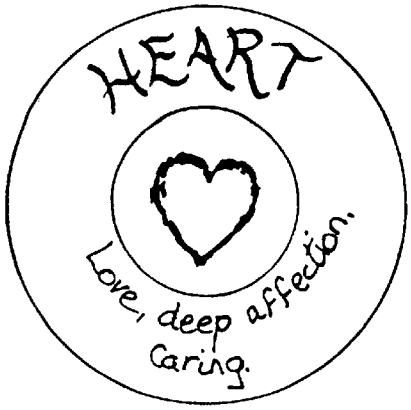
Figure 1:
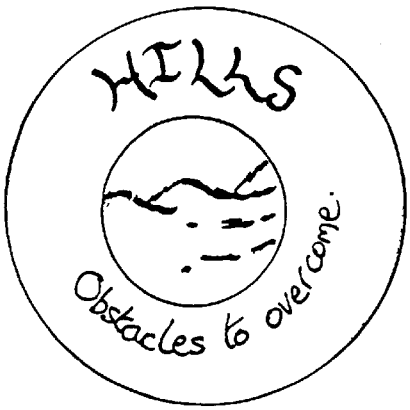
Figure 1:
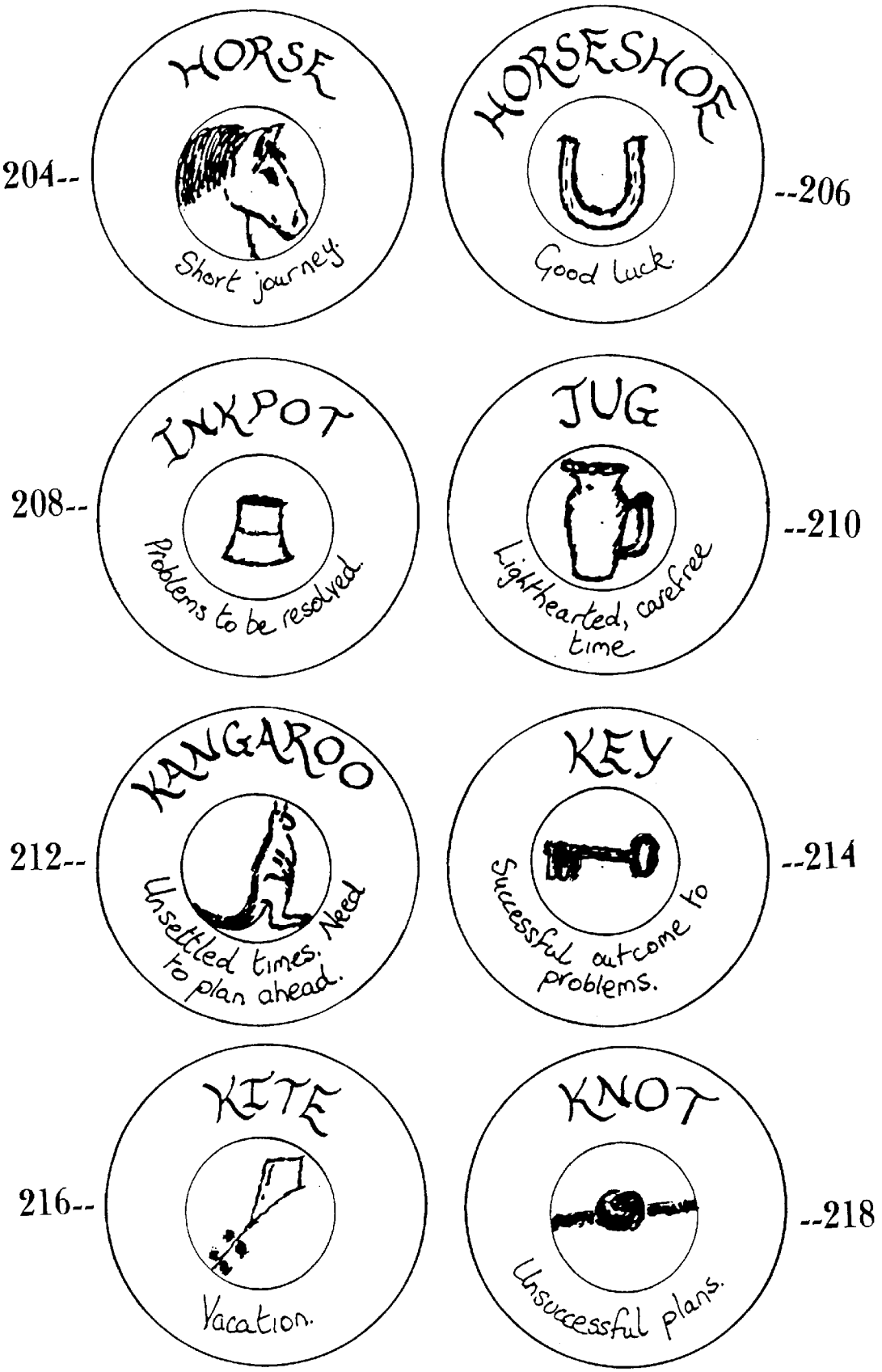
Figure 1:
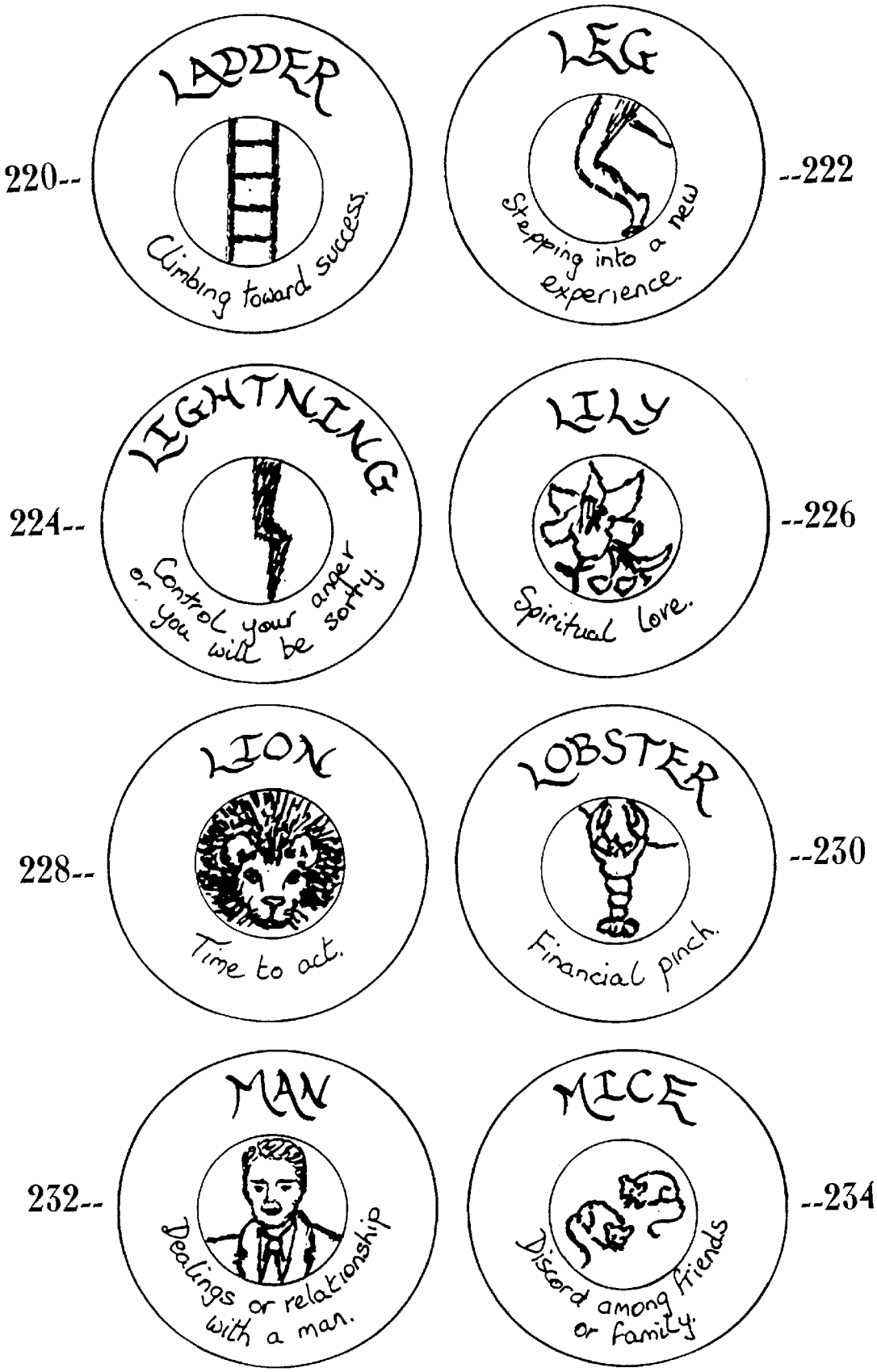
Figure 1:
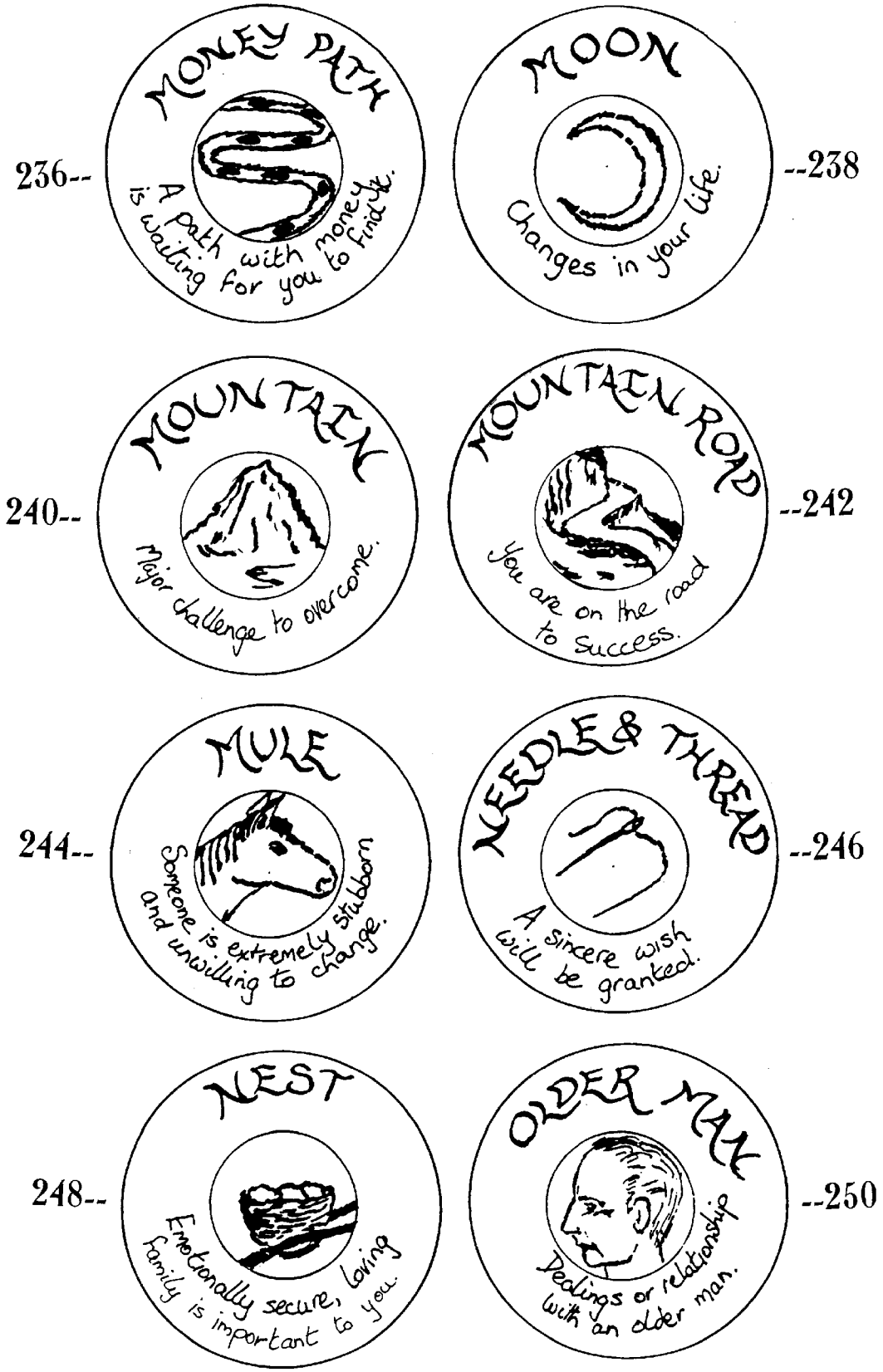
Figure 1:
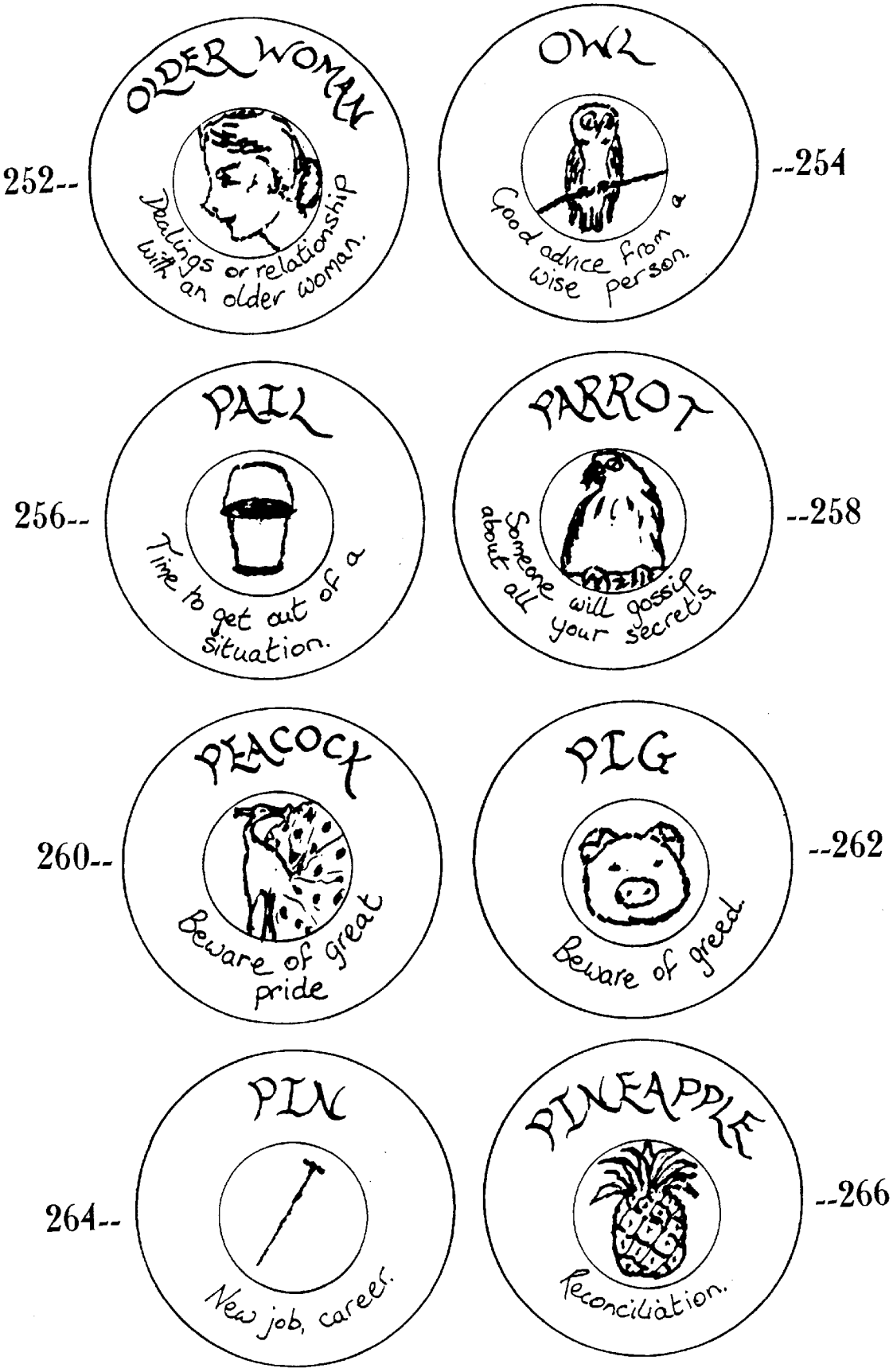
Figure 1:
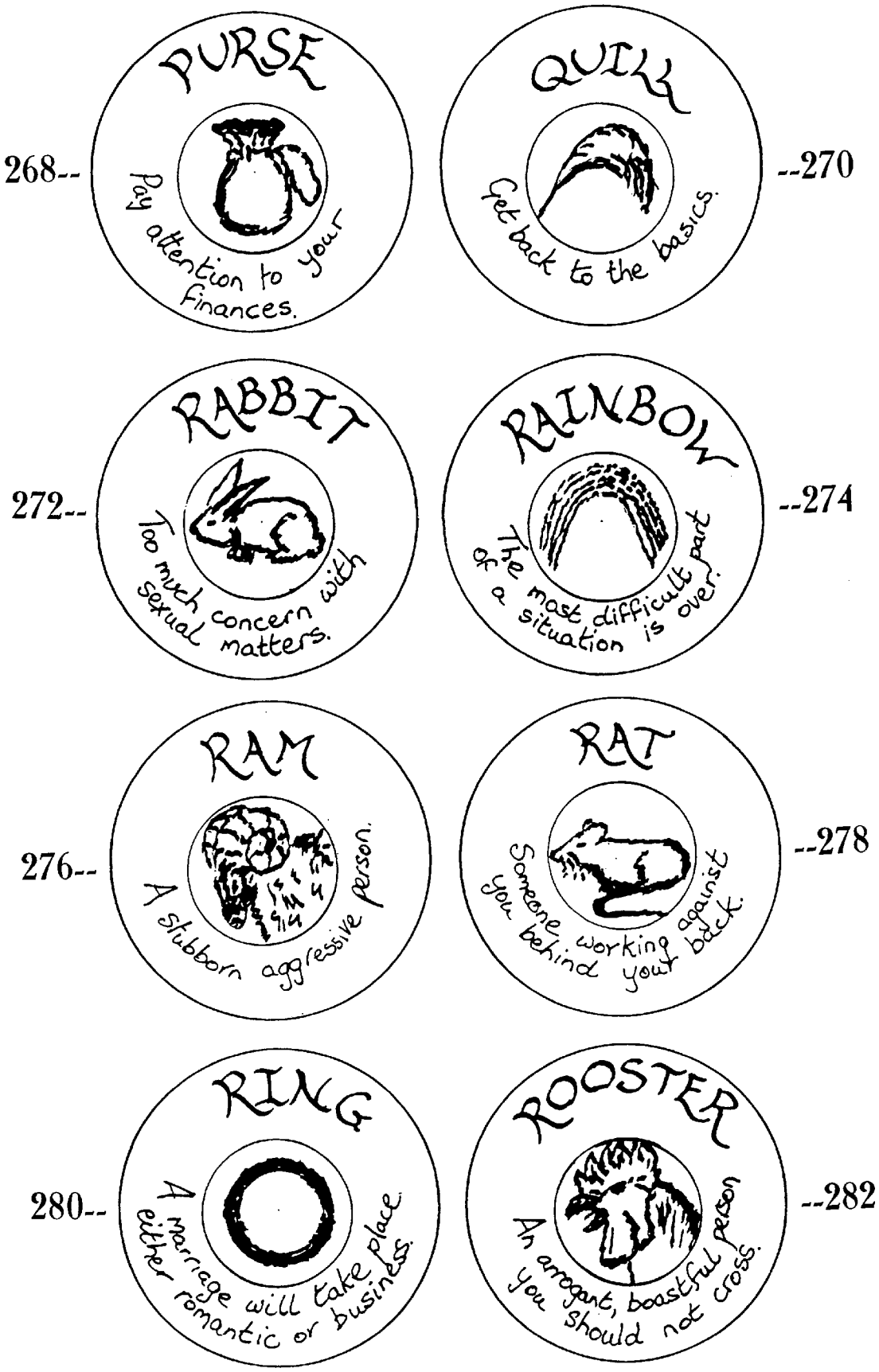
Figure 1:
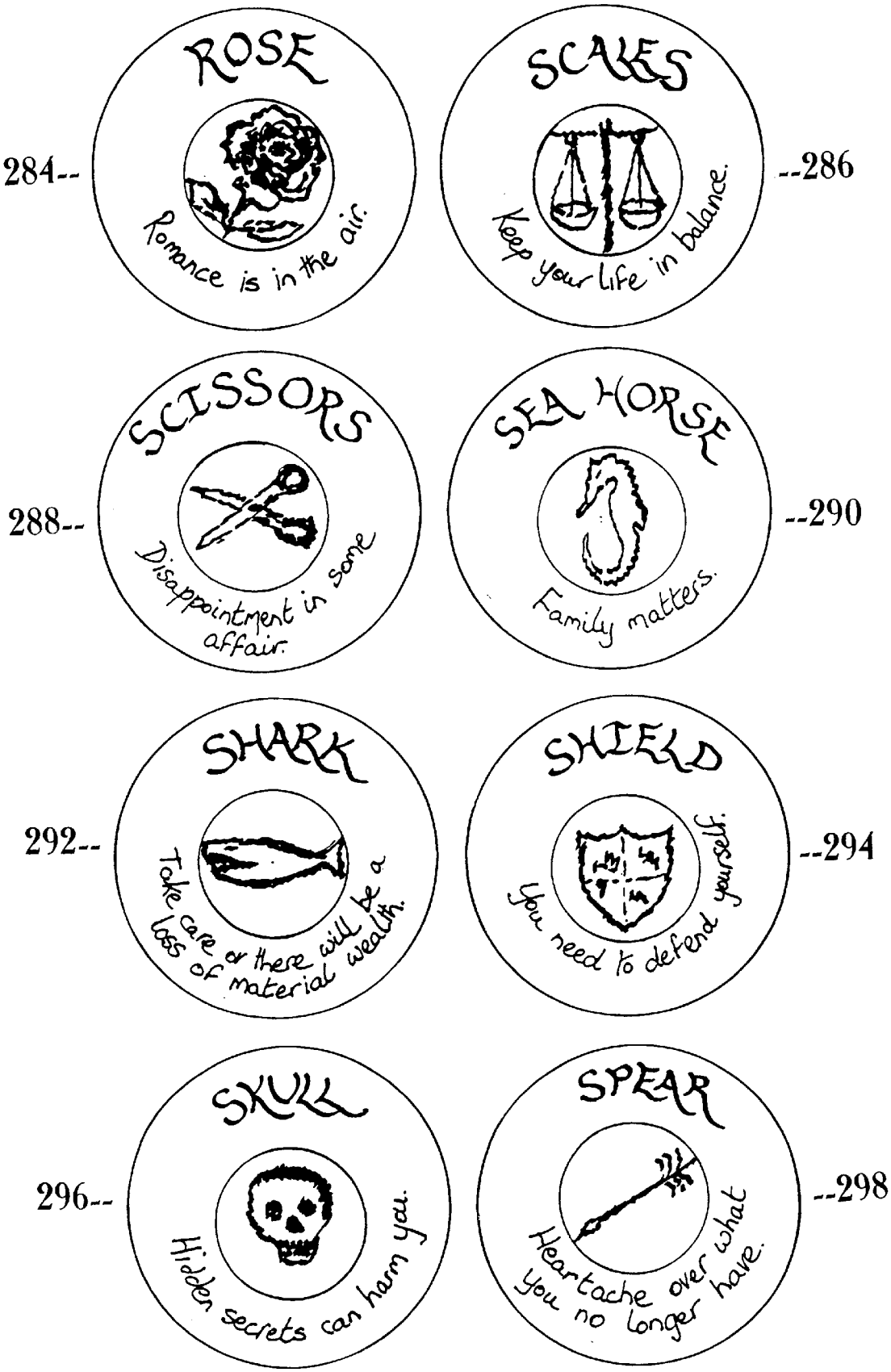
Figure 1:
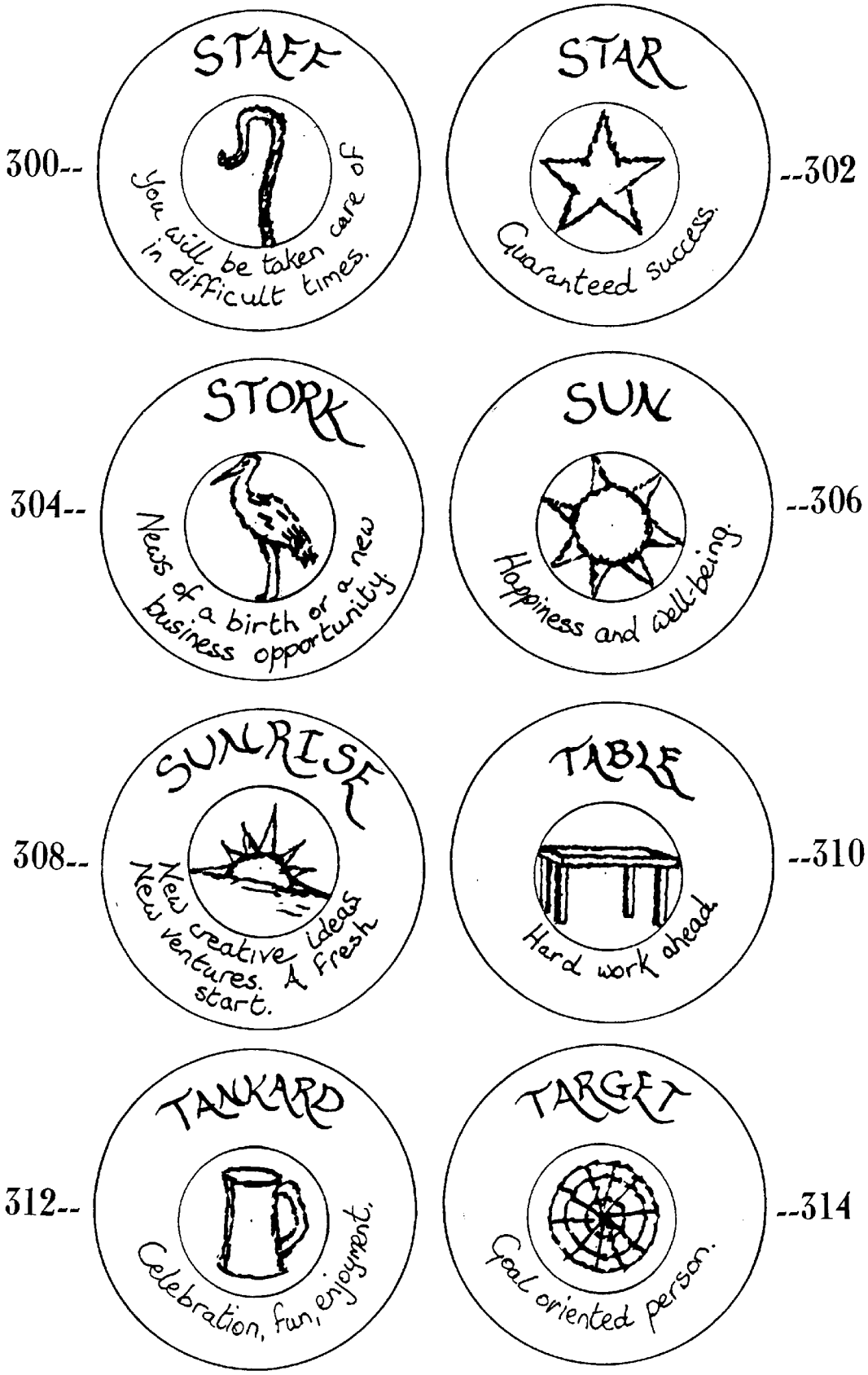
Figure 1:
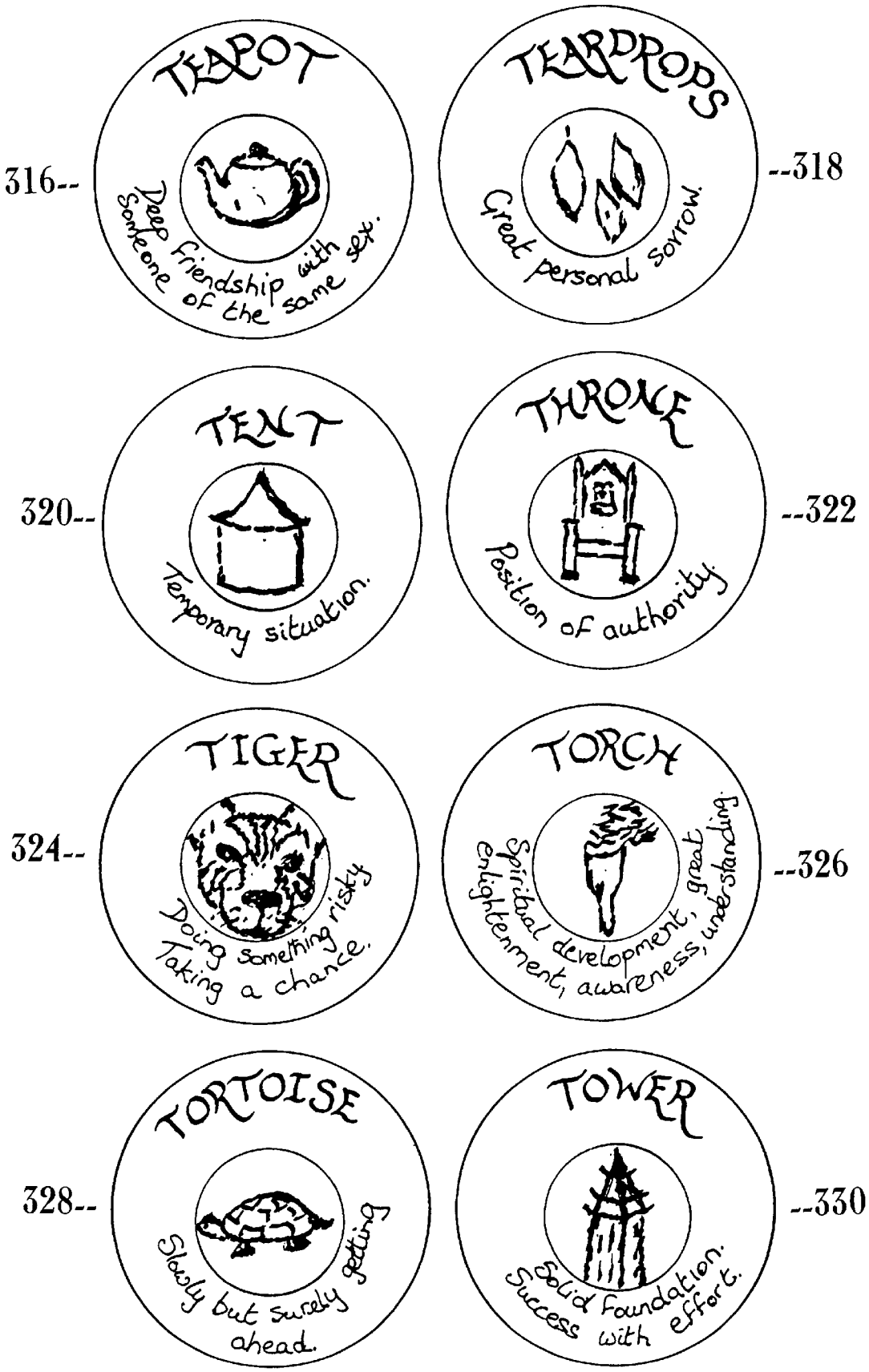
Figure 1:
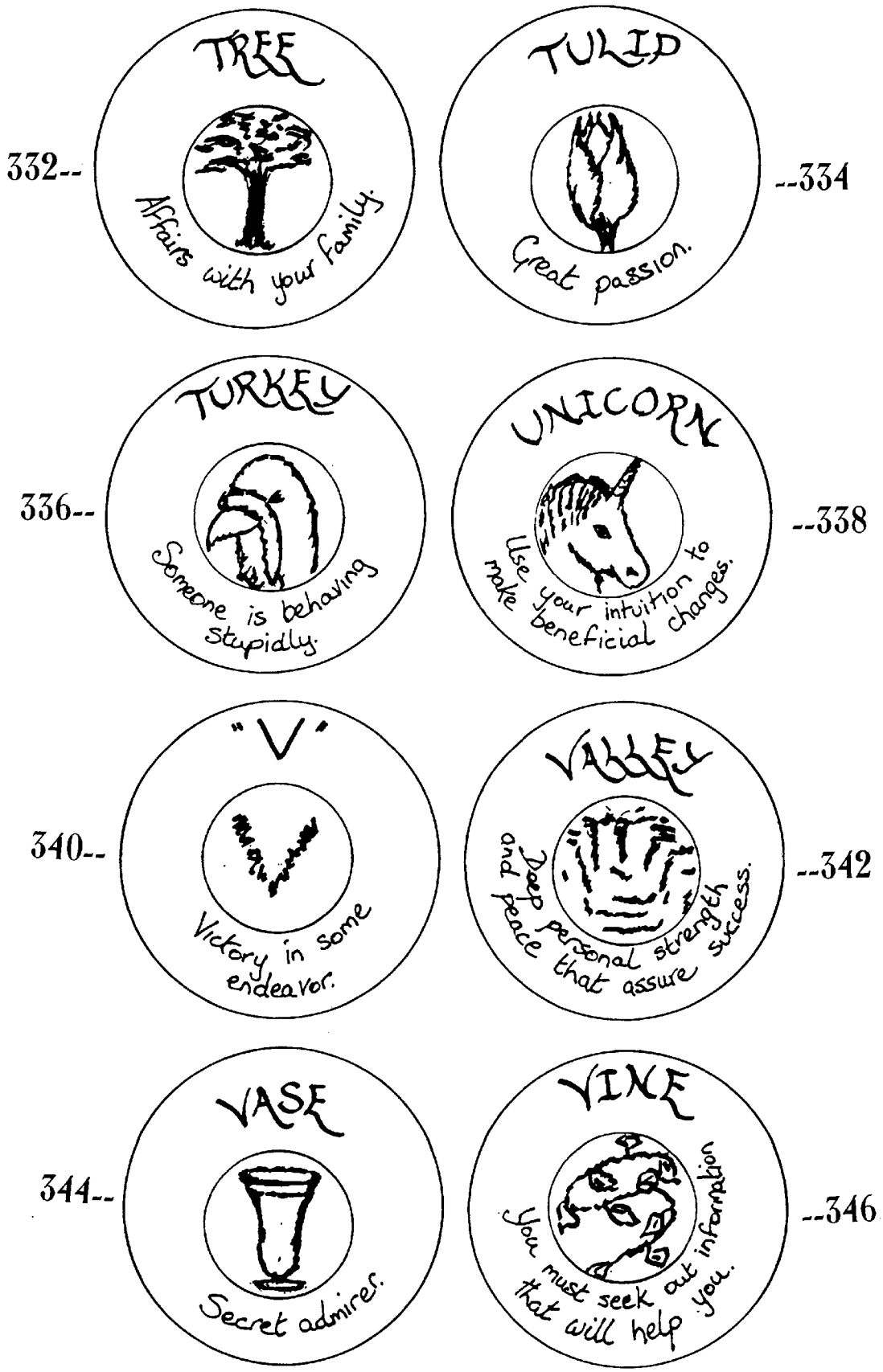
Figure 1:
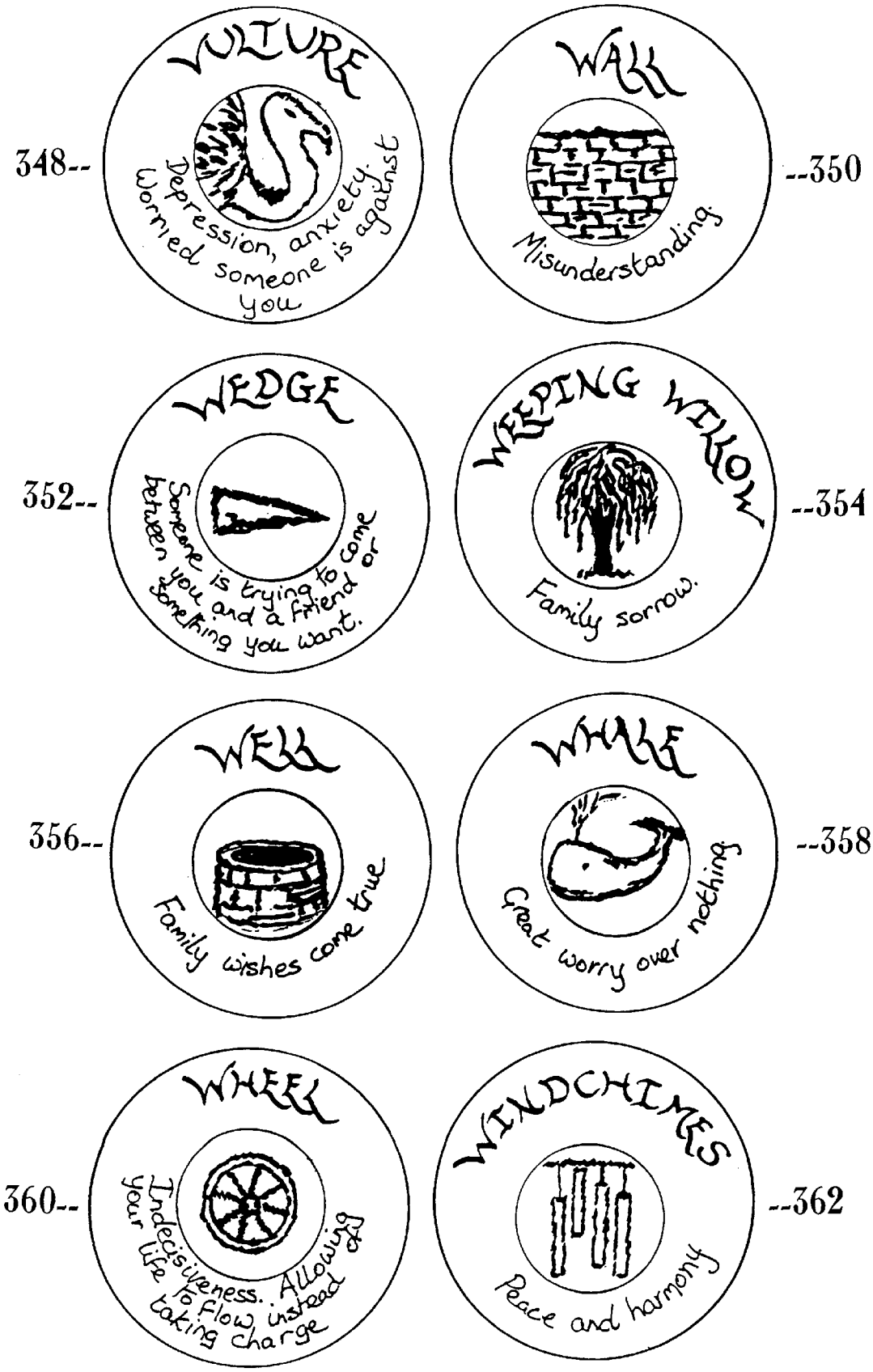
Figure 1:
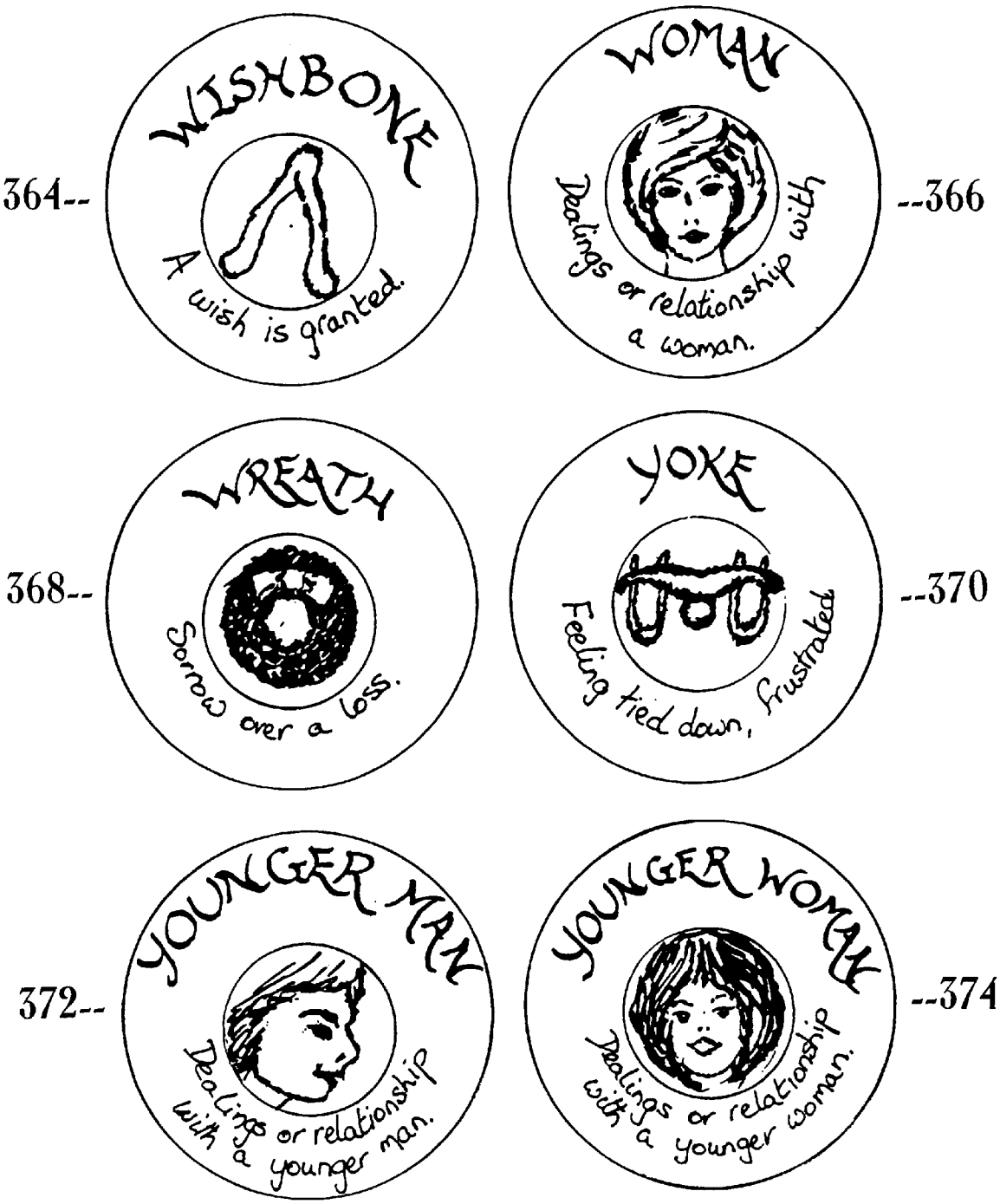
Figure 2:
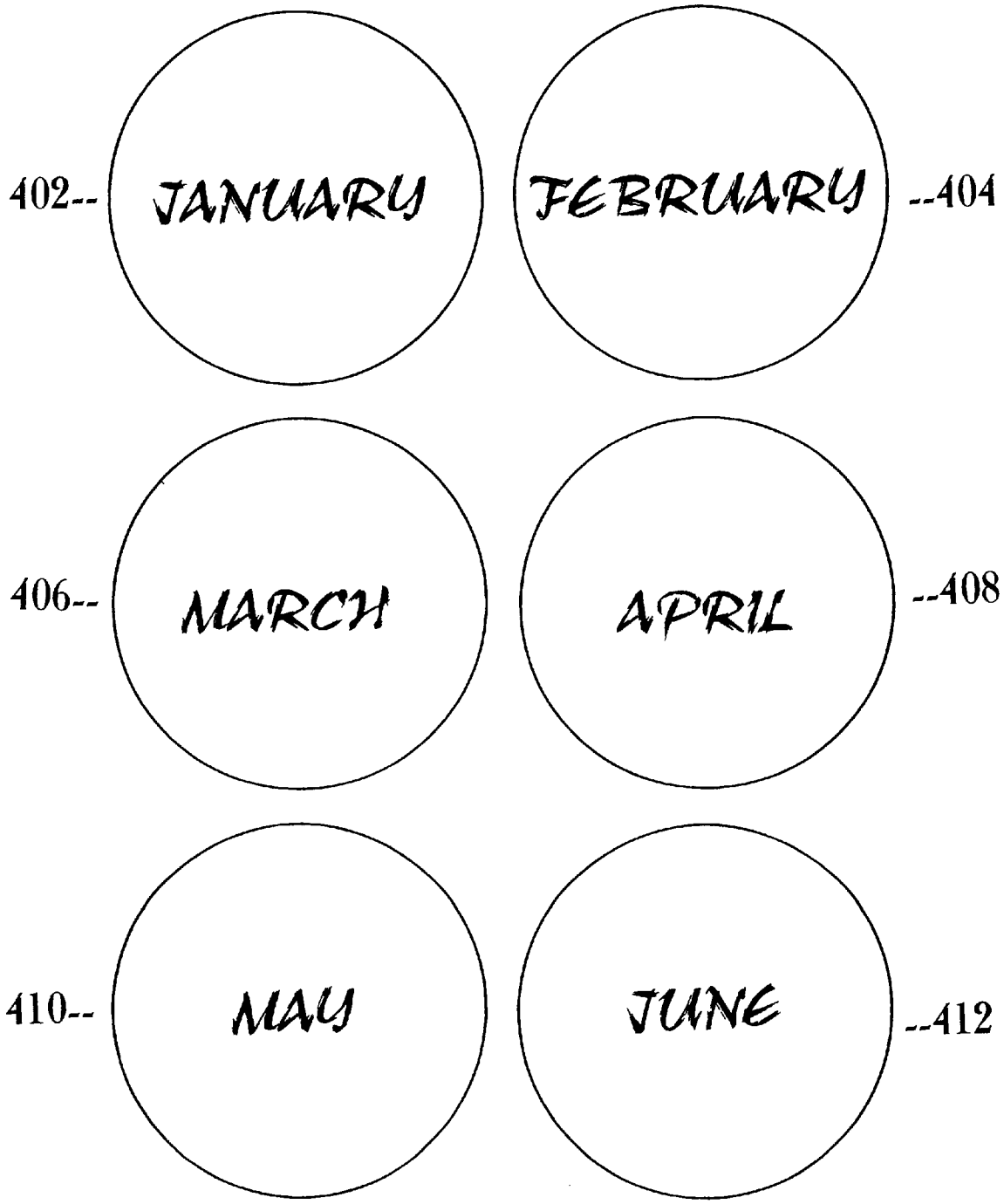
FIG. 2 are top view of month cards.
Figure 2:
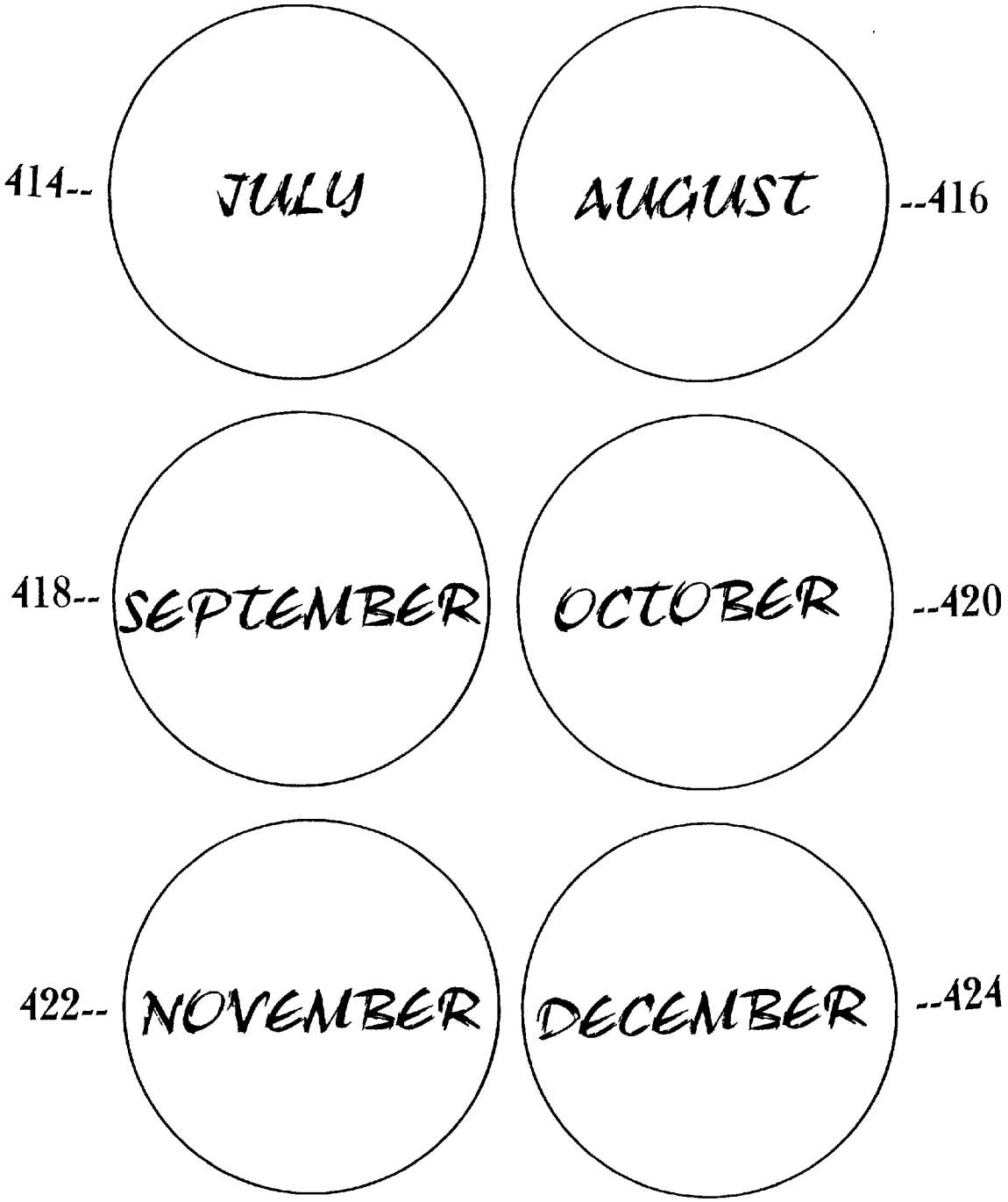
Figure 3:
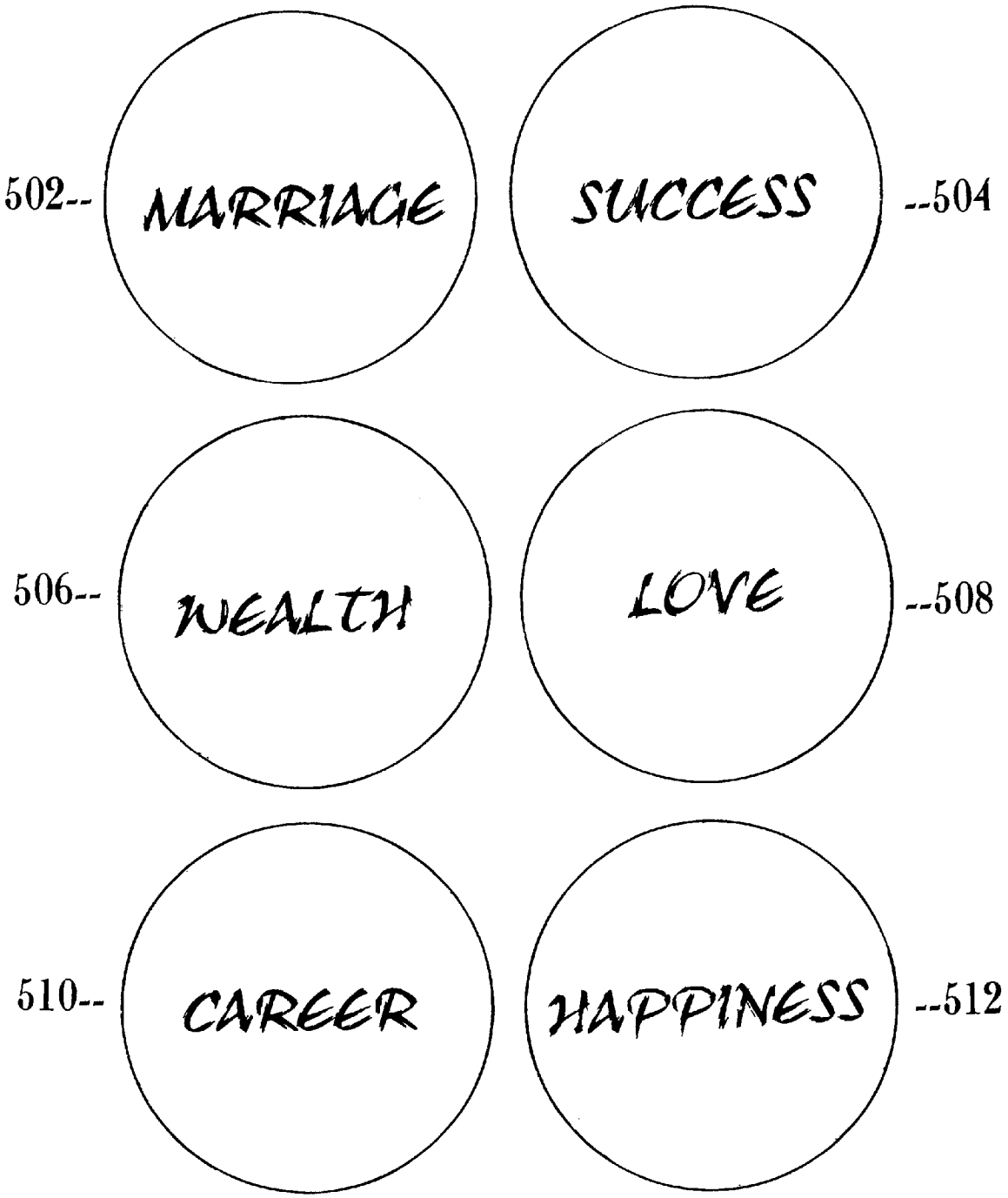
FIG. 3 are top views of astral house cards.
Figure 5:
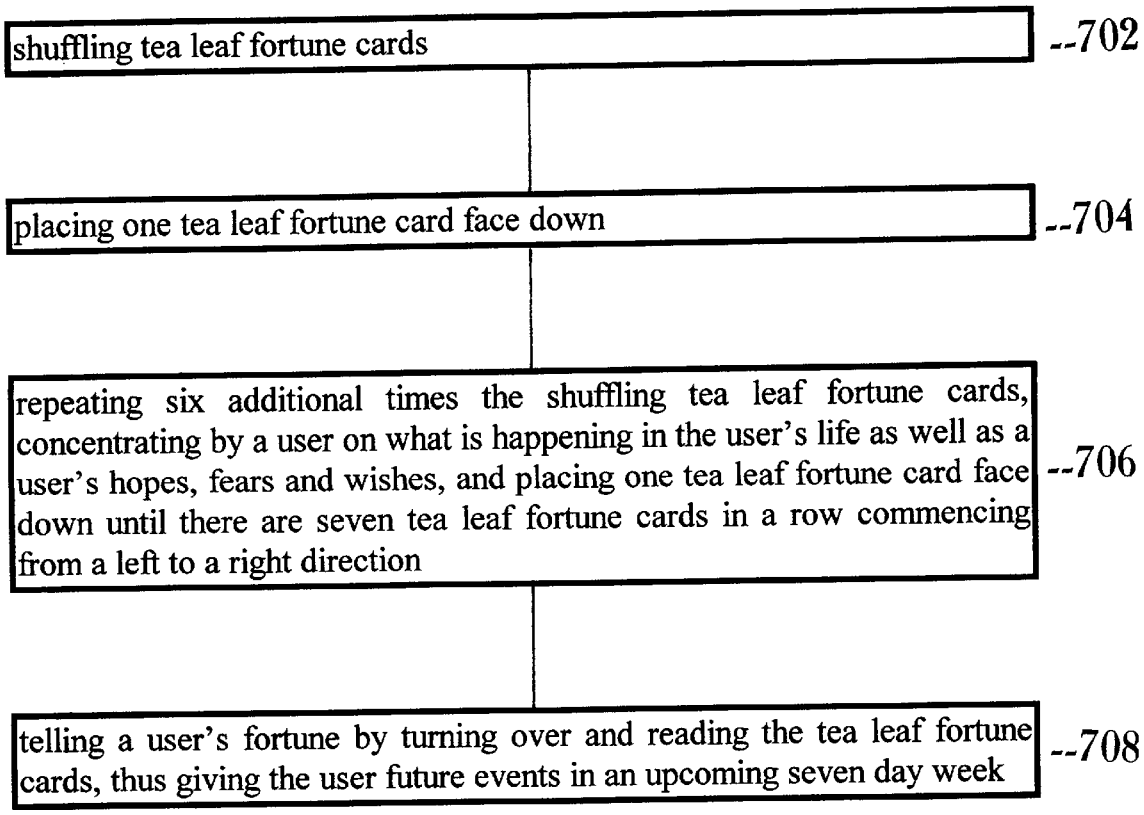
FIG. 5 is a diagrammatic view of a method of predicting a future for an upcoming week.

Referring to FIG. 5 which is a diagrammatic view of a method of predicting a future for an upcoming week 700 exhibiting the following steps: shuffling tea leaf fortune cards 702; concentrating by a user on what's happening in the user's life as well as a user's hopes, fears and wishes 704; placing one tea leaf fortune card face down 706; repeating six additional times the shuffling tea leaf fortune cards, concentrating by a user on what's happening in the user's life as well as a user's hopes, fears and wishes, and placing one tea leaf fortune card face down until there are seven tea leaf fortune cards in a row commencing from a left to a right direction 708; and telling a user's fortune by turning over and reading the tea leaf fortune cards, thus giving the user future events in an upcoming seven day week 710. Laterally shuffling or mixing all of the tea leaf fortune cards as shown in FIG. 1. It is not preferable to utilize a "gamblers shuffle" for example: halving the deck and shuffling it end to end. A user must concentrate on what is happening in that user's life as well as that user's hopes, fears, and wishes. When a user feels he or she has shuffled the cards or mixed the cards enough, the user places one tea leaf fortune card 10 in a face down position. The process is repeated six times until there are seven cards face down in a row. It is necessary for a user to shuffle between selections of the tea leaf fortune cards 10.

The user then turns over the cards. The tea leaf fortune cards 10 will tell the user the positive and negative energy surrounding him or her in the upcoming week.

Figure 6:
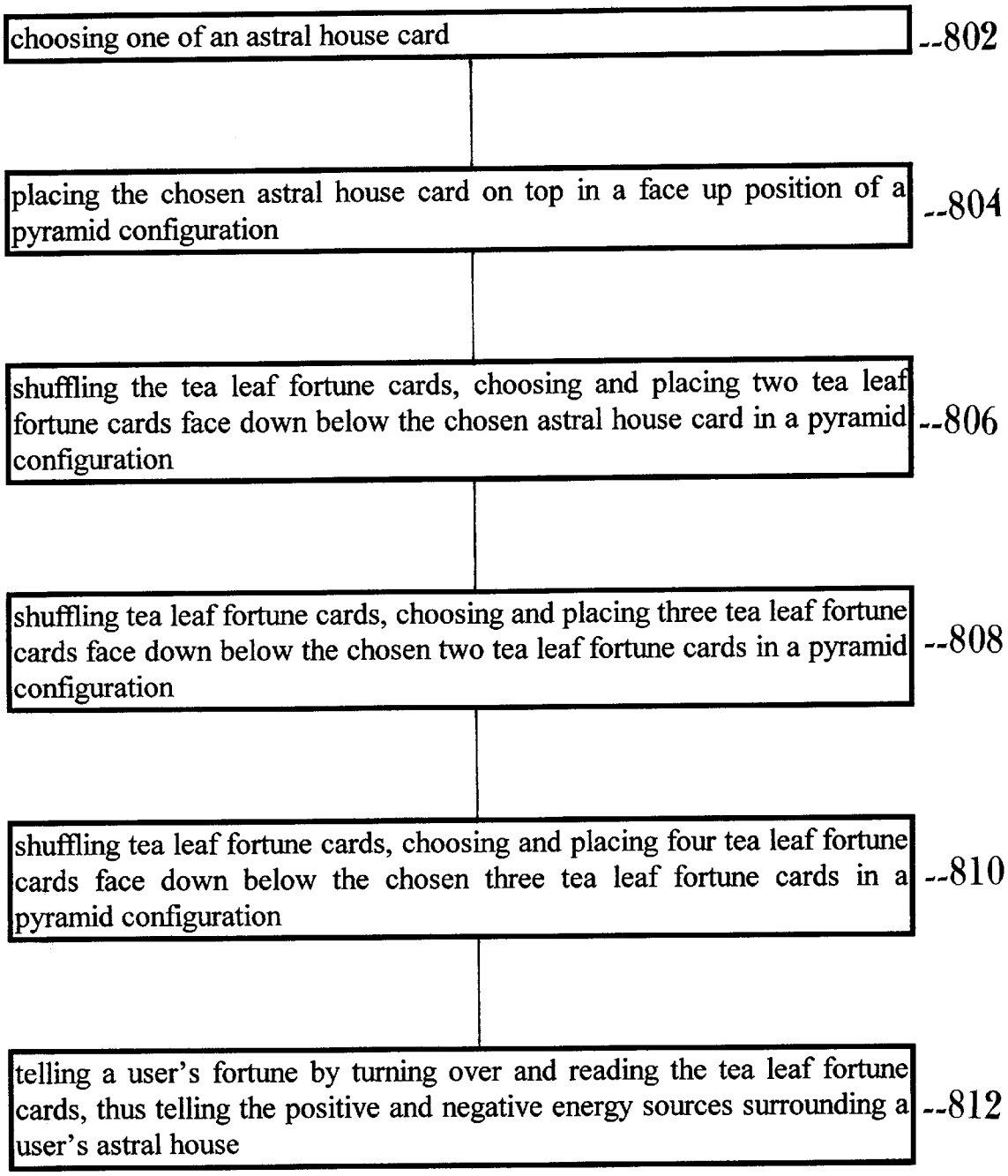
FIG. 6 is a diagrammatic view of a method of predicting an answer to a specific question.

Lastly, referring to FIG. 6 which is a diagrammatic view of a method of predicting an answer to a specific question 800 exhibiting the following steps: choosing one of an astral house card 802; placing the chosen astral house card on top in a face up position of a pyramid configuration 804; shuffling tea leaf fortune cards choosing and placing two tea leaf fortune cards below the chosen astral house card in a pyramid configuration 806; shuffling tea leaf fortune cards choosing and placing three tea leaf fortune cards below the chosen two tea leaf fortune cards in a pyramid configuration 808; shuffling teal leaf fortune cards choosing and placing four tea leaf fortune cards below the chosen three tea leaf fortune cards in a pyramid configuration 810; and telling a user's fortune by tuning over and reading the tea leaf fortune cards, thus telling a user energy sources surrounding an astral house 812. This method utilizes an astral house pyramid to yield answers to specific questions. The user first chooses one of the astral house cards 500 and places atop of an imaginary pyramid. The user then laterally shuffles or mixes all of the tea leaf fortune cards 10. It is not preferable to utilize a "gamblers shuffle" for example: halving the deck and shuffling it end to end. The user then chooses two tea leaf fortune cards 10 and places them face down below the astral house card 500 to begin forming a pyramid configuration. The user then shuffles the tea leaf fortune cards 10 and chooses three tea leaf fortune cards 10 and places them face down below the two tea leaf fortune cards 10 continuing to form a pyramid configuration. The user then shuffles the tea leaf fortune cards 10 and chooses four tea leaf fortune cards 10 and places them face down below the three tea leaf fortune cards 10 continuing to form a pyramid configuration. The user then turns over the tea leaf fortune cards 10 and reads them. The tea leaf fortune cards 10 will tell the user the positive and negative energy surrounding the user's astral house at that moment.

It win be understood that each of the elements described above, or two or more together, may also find a useful application in other types of constructions differing from the type described above.

While the invention has been illustrated and described as embodied in a fortune telling game, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. A method of playing a fortune telling game comprising at least one tea leaf fortune playing card, the method consisting of the following steps:

A) arranging twelve cards in a face up position in a circle representing twelve months of the year starting with a current month at the top;

B) shuffling laterally all tea leaf fortune cards;

C) shuffling tea leaf fortune cards and covering each month card with a tea leaf fortune card in a clockwise rotational direction with a tea leaf fortune card in a face down position beginning with the current month;

D) repeating the shuffling the tea leaf fortune cards and covering each month card with a tea leaf fortune card in a clockwise rotational direction with a tea leaf fortune card in a face down position beginning with the current month until there are four tea leaf fortune cards on each month;

E) telling a user's fortune by turning over and reading the tea leaf fortune cards for the current month, the tea leaf fortune cards, thus giving the user the future events for the current month; and F) proceeding with telling a user's fortune by turning over and reading the tea leaf fortune cards for other months, the tea leaf fortune cards, thus giving the user future events for the other months until all other months have been completed of a future year.

2. The method of playing the fortune telling game as described in claim 1, wherein the at least one tea leaf fortune card further comprises graphic symbols and correlating predictions, respectively, printed on a same side of the tea leaf fortune card, selected from a group of tea leaf fortune cards consisting of: ANGEL, Representing spiritual guidance, Protection from harm; ANT, Representing work, achievement, success; APPLE, Representing temptation will test you; ARCHWAY, Representing new opportunities, possibilities, paths opening up; ARROW, Representing you are on the right path regarding some aspect of your life, AX, Representing forces working against you; BAG, Representing something important like a new job and a raise; BARREL, Representing you feel something is lacking in your life, Could be love, money, goals; BASKET, Representing recognition, Reward for merit; BAT, Representing take care—enemies are working against you; BEAR, Representing danger, especially in money matter; BEETLE, Representing good fortune; BELL, Representing announcement; BIRD-FLYING, Representing news is on the way; BIRD-PERCHED, Representing waiting for news, package, letter; BOAT, Representing money and property through an inheritance, winnings and windfall; BOOT, Representing increase your efforts if you want to achieve your goals; BOUQUET, Representing compliments from an admirer; BOW, Representing you are highly thought of; BOWL, Representing plenty of material things, BOX, Representing you will receive a gift; BREAD, Representing period of prosperity and plenty; BRIDGE, Representing successfiully overcoming a problem; BROKEN BRIDGE, Representing unsuccessful outcome to a problem; BROKEN RING, Representing parting of the ways in either romance and business; BROKEN WISHBONE, Representing wish will not be granted; BROOM, Representing new home; BULL, Representing do not back down from opposition, Show strength and fortitude; BUTTERFLY, Representing a change for the better; CAMEL, Representing persevere and you will overcome problems; CANDLE, Representing you will be shown the way; CANE, Representing pay attention to your health;

CARRIAGE, Representing a journey either physically and mentally; CARROT, Representing opportunity and windfall; CASKET, Representing someone going out of your life and the end of a situation; CAT, Representing a two-faced friend; CATERPILLAR, Representing someone is jealous of you; CHAIN, Representing chain of events that will affect your life; CHAIR-FILLED, Representing someone new is entering your life; CLAW, Representing be careful-do not take risks; CLOUDS, Representing temporary problems; CLUB, Representing someone will try to make you do something against your will; COBWEB, Representing protected from negative forces beyond your control; COINS, Representing money will be coming to you; CRACKED CUP, Representing dissatisfaction with life; CRIB, Representing birth and conception of a child and enterprise; CROWN, Representing honor and respect will come to you; CUP, Representing you should accept valid criticism; DAGGER, Representing fear, worries, tense situations; DARK MAN; Representing dealings and relationship with a man with dark complexion and hair; DARK WOMAN, Representing dealings and relationship with a woman with dark complexion and hair; DESK, Representing pay attention to your work; DIAMOND, Representing gift of jewelry; DOG, Representing protection from a powerful friend; DOGS, Representing getting together with friends; DOG-BARKING, Representing advice from a friend; DOG-CLOSE UP, Representing pleasure with a close friend; DOG-FAR AWAY, Representing a distant friend is taking about you; DOLPHIN, Representing financial gain, Usually coming from something you did in the past; DOOR, Representing opportunities are awaiting you; DRAGON, Representing beware of self-delusion; EAGLE, Representing triumph over troubles, obstacles; EAR, Representing good news; EGG, Representing success assured with good plans and hard work; ELEPHANT, Representing long journey either physically and mentally; EMPTY CHAIR, Representing someone leaving your life; EYE, Representing psychic ability; FAIR MAN, Representing dealings and relationship with a man with light complexion and hair; FAIR WOMAN, Representing dealings and relationship with a woman with light complexion and hair; FAN, Representing romance, celebration, party; FEATHER, Representing someone you know is undependable, insincere; FINGER, Representing warning you of a problem either now and in the new future; FIRE, Representing strong emotion, Passionate love and hate; FIRECRACKER, Representing excitement; FLAG, Representing do not be tempted to lower your standards; FLOWERS, Representing Happiness; FLUTE, Representing disappointment in a friend and lover; FLY, Representing a period of ill health; FOREST, Representing mudded, unclear thinking; FOUR LEAF CLOVER, Representing great good fortune; FOX, Representing shrewdness and resourcefulness especially in business; FRYING PAN, Representing trouble, accusations; FUNNEL, Representing period of frustration, Lessons to be learned; GAVEL, Representing involvement with the law; GOLDFISH, Representing increase in material wealth and spiritual growth; GONG, Representing an exciting event; GRAPES, Representing time to go out and have fun; GRASSHOPPER, Representing situations in the balance that require careful handling; HAMMOCK, REPRESENTING taking a vacation, physically and mentally; HAND, Representing in need of help, assistance, guidance; HANDSHAKE, Representing a meeting with a stranger could be important; HARP, Representing great happiness, HAT, Representing you will be playing a different role; HAYSTACK, Representing karma—you will reap what you have sown; HEART, Representing love, deep affection, caring; HILLS, Representing obstacles to overcome; HORSE, Representing short journey; HORSESHOE, Representing good luck; INKPOT, Representing problems to be resolved; JUG, Representing lighthearted, carefree time; KANGAROO, Representing unsettled times, Need to plan ahead; KEY, Representing successful outcome to problems; KITE, Representing vacation; KNOT, Representing unsuccessful plans; LADDER, Representing climbing toward success; LEG, Representing stepping into a new experience; LIGHTNING, Representing control your anger and you will be sorry; LILY, Representing spiritual love; LION, Representing time to act; LOBSTER, Representing financial pinch; MAN, Representing dealings and relationship with a man; MICE, Representing discord among friends and family; MONEY PATH, Representing a path with money is waiting for you to find it; MOON, Representing changes in your life; MOUNTAIN, Representing major challenge to overcome; MOUNTAIN ROAD Representing you are on the road to success; MULE, Representing someone is extremely stubborn and unwilling to change; NEEDLE & THRAD, Representing a sincere wish will be granted; NEST, Representing emotionally secure, loving family; OLDER MAN, Representing dealings and relationship with an older man; OLDER WOMAN, Representing dealings and relationship with an older woman; OWL, Representing good advice from a wise person; PAIL, Representing time to get out of a situation; PARROT, Representing someone will gossip about all your secrets; PEACOCK, Representing beware of great pride; PIG, Representing beware of greed; PIN, Representing new job, career; PINEAPPLE, Representing reconciliation; PURSE, Representing pay attention to your finances; QUILL, Representing get back to the basics; RABBIT, Representing too much concern with sexual matters; RAINBOW, Representing the most difficult part of a situation is over; RAM, Representing a stubborn, aggressive person; RAT, Representing someone working against you behind your back; RING, Representing a marriage will take place, either romantic and business; ROOSTER, Representing an arrogant, boastful person you should not cross; ROSE, Representing romance is in the air; SCALES, Representing keep your life in balance; SCISSORS, Representing disappointment in some affair; SEA HORSE, Representing family matters; SHARK, Representing take care and there will be a loss of material wealth; SHIELD, Representing you need to defend yourself; SKULL, Representing hidden secrets can harm you; SPEAR, Representing heartache over what you no longer have; STAFF, Representing you will be taken care of in difficult times; STAR, Representing guaranteed success; STORK, Representing news of a birth and a new business opportunity; SUN, Representing happiness and well being; SUNRISE, Representing new creative ideas, New ventures, A fresh start; TABLE, Representing favorable period for you; TANKARD, Representing celebration, fun, enjoyment; TARGET, Representing goal oriented person; TEAPOT, Representing deep friendship with someone of the same sex; TEARDROPS, Representing great personal sorrow; TENT, Representing temporary situation; THRONE, Representing position of authority; TIGER, Representing doing something risky, Taking a chance; TORCH, Representing spiritual development, great enlightenment, awareness, understanding; TORTOISE, Representing slowly but surely getting ahead; TOWER, Representing solid foundation, Success with effort; TREE, Representing affairs with your family; TULIP, Representing great passion; TURKEY, Representing someone is behaving stupidly; UNICORN, Representing use your intuition to make beneficial changes; V, Representing victory in some endeavor; VALLEY, Representing deep personal strength and peace that assure success; VASE, Representing secret admirer; VINE, Representing you must seek out information that will help you; VULTURE, Representing beware of a person who wants something you have; WALL, Representing misunderstanding; WEDGE, Representing someone is trying to come between you and a friend and something you want; WEEPING WILLOW, Representing family sorrow; WELL, Representing family wishes come true; WHALE, Representing great worry over nothing; WHEEL, Representing indecisiveness, Allowing your life to flow instead of taking charge; WINDCHIMES, Representing peace and harmony; WISHBONE, Representing a wish is granted; WOMAN, Representing dealings and a relationship with a woman; WREATH, Representing sorrow over a loss; YOKE, Representing feeling tied down, frustrated; YOUNGER MAN, Representing dealings and relationship with a younger man; and YOUNGER WOMAN, Representing dealings and relationship with a younger woman.

3. The method of playing the fortune telling game as described in claim 1, wherein the at least one tea leaf fortune card further comprises decorative indicia on an opposite side of the card than the graphic symbols and correlating predictions.

4. The method of playing the fortune telling game as described in claim 1, wherein a Julian month is selected from a group of months consisting of January, February, March, April, May, June, July, August, September, October, November, and December.

5. The method of playing the fortune telling game as described in claim 4, wherein the Julian month card has decorative indicia printed on an opposite side than the Julian month.

6. A method of playing a fortune telling game comprising at least one tea leaf fortune playing card, the method consisting of the following steps:

A) choosing one of an astral house card;

B) placing the chosen astal house card on top in a face up position of a pyramid configuration shuffling tea leaf fortune cards choosing and placing two tea leaf fortune cards below the chosen astral house card in a pyramid configuration;

C) shuffling tea leaf fortune cards choosing and placing three tea leaf fortune cards below the chosen two tea leaf fortune cards in a pyramid configuration;

D) shuffling tea leaf fortune cards choosing and placing four tea leaf fortune cards below the chosen three tea leaf fortune cards in a pyramid configuration; and E) telling a user's fortune by turning over and reading tea leaf fortune cards, thus telling a user energy sources surrounding a user's astral house.

7. The method of playing the fortune telling game as described in claim 6, wherein the at least one tea leaf fortune card further comprises graphic symbols and correlating predictions, respectively, printed on a same side of the tea leaf fortune card, selected from a group of tea leaf fortune cards consisting of: ANGEL, Representing spiritual guidance, Protection from harm; ANT, Representing work, achievement, success; APPLE, Representing temptation will test you; ARCHWAY, Representing new opportunities, possibilities, paths opening up; ARROW, Representing you are on the right path regarding some aspect of your life, AX, Representing forces working against you; BAG, Representing something important like a new job and a raise; BARREL, Representing you feel something is lacking in your life, Could be love, money, goals; BASKET, Representing recognition, Reward for merit; BAT, Representing take care—enemies are working against you; BEAR, Representing danger, especially in money matter; BEETLE, Representing good fortune; BELL, Representing announcement; BIRD-FLYING, Representing news is on the way; BIRD-PERCHED, Representing waiting for news, package, letter; BOAT, Representing money and property through an inheritance, winnings and windfall; BOOT, Representing increase your efforts if you want to achieve your goals; BOUQUET, Representing compliments from an admirer; BOW, Representing you are highly thought of; BOWL, Representing plenty of material things, BOX, Representing you will receive a gift; BREAD, Representing period of prosperity and plenty; BRIDGE, Representing successfully overcoming a problem; BROKEN BRIDGE, Representing unsuccessful outcome to a problem; BROKEN RING, Representing parting of the ways in either romance and business; BROKEN WISHBONE, Representing wish will not be granted; BROOM, Representing new home; BULL, Representing do not back down from opposition, Show strength and fortitude; BUTTERFLY, Representing a change for the better; CAMEL, Representing persevere and you will overcome problems; CANDLE, Representing you will be shown the way; CANE, Representing pay attention to your health; CARRIAGE, Representing a journey either physically and mentally; CARROT, Representing opportunity and windfall; CASKET, Representing someone going out of your life and the end of a situation; CAT, Representing a two-faced friend; CATERPILLAR, Representing someone is jealous of you; CHAIN, Representing chain of events that will affect your life; CHAIR-FILLED, Representing someone new is entering your life; CLAW, Representing be careful-do not take risks; CLOUDS, Representing temporary problems; CLUB, Representing someone will try to make you do something against your will; COBWEB, Representing protected from negative forces beyond your control; COINS, Representing money will be coming to you; CRACKED CUP, Representing dissatisfaction with life; CRIB, Representing birth and conception of a child and enterprise; CROWN, Representing honor and respect will come to you; CUP, Representing you should accept valid criticism; DAGGER, Representing fear, worries, tense situations; DARK MAN; Representing dealings and relationship with a man with dark complexion and hair; DARK WOMAN, Representing dealings and relationship with a woman with dark complexion and hair; DESK, Representing pay attention to your work; DIAMOND, Representing gift of jewelry; DOG, Representing protection from a powerful friend; DOGS, Representing getting together with friends; DOG-BARKING, Representing advice from a friend; DOG-CLOSE UP, Representing pleasure with a close friend; DOG-FAR AWAY, Representing a distant friend is thinking about you; DOLPHIN, Representing financial gain, Usually coming from something you did in the past; DOOR, Representing opportunities are awaiting you; DRAGON, Representing beware of self-delusion; EAGLE, Representing triumph over troubles, obstacles; EAR, Representing good news; EGG, Representing success assured with good plans and hard work; ELEPHANT, Representing long journey either physically and mentally; EMPTY CHAIR, Representing someone leaving your life; EYE, Representing psychic ability; FAIR MAN, Representing dealings and relationship with a man with light complexion and hair; FAIR WOMAN, Representing dealings and relationship with a woman with light complexion and hair; FAN, Representing romance, celebration, party; FEATHER, Representing someone you know is undependable, insincere; FINGER, Representing warning you of a problem either now and in the new future; FIRE, Representing strong emotion; Passionate love and hate; FIRECRACKER, Representing excitement; FLAG, Representing do not be tempted to lower your standards; FLOWERS, Representing Happiness; FLUTE, Representing disappointment in a friend and lover; FLY, Representing a period of ill health; FOREST, Representing muddled, unclear thinking; FOUR LEAF CLOVER, Representing great good fortune; FOX, Representing shrewdness and resourcefulness especially in business; FRYING PAN, Representing trouble, accusations; FUNNEL, Representing period of frustration; Lessons to be learned; GAVEL, Representing involvement with the law; GOLDFISH, Representing increase in material wealth and spiritual growth; GONG, Representing an exciting event; GRAPES, Representing time to go out and have fun; GRASSHOPPER, Representing situations in the balance that require careful handling; HAMMOCK, REPRESENTING taking a vacation, physically and mentally; HAND, Representing in need of help, assistance, guidance; HANDSHAKE, Representing a meeting with a stranger could be important; HARP, Representing great happiness, HAT, Representing you will be playing a different role; HAYSTACK, Representing karma—you will reap what you have sown; HEART, Representing love, deep affection, caring; HILLS, Representing obstacles to overcome; HORSE, Representing short journey; HORSESHOE, Representing food luck; INKPOT, Representing problems to be resolved; JUG, Representing lighthearted, carefree time; KANGAROO, Representing unsettled times, Need to plan ahead; KEY, Representing successful outcome to problems; KITE, Representing vacation; KNOT, Representing unsuccessful plans; LADDER, Representing climbing toward success; LEG, Representing stepping into a new experience; LIGHTNING, Representing control your anger and you will be sorry; LILY, Representing spiritual love; LION, Representing time to act; LOBSTER, Representing financial pinch; MAN, Representing dealings and relationship with a man; MICE, Representing discord among friends and family; MONEY PATH, Representing a path with money is waiting for you to find it; MOON, Representing changes in your life; MOUNTAIN, Representing major challenge to overcome; MOUNTAIN ROAD, Representing you are on the road to success; MULE, Representing someone is extremely stubborn and unwilling to change; NEEDLE & THREAD, Representing a sincere wish will be granted; NEST, Representing emotionally secure, loving family; OLDER MAN, Representing dealings and relationship with an older man; OLDER WOMAN, Representing dealings and relationship with an older woman; OWL, Representing good advice from a wise person; PAIL, Representing time to get out of a situation; PARROT, Representing someone will gossip about all your secrets; PEACOCK, Representing beware of great pride; PIG, Representing beware of greed; PIN, Representing new job, career; PINEAPPLE, Representing reconciliation; PURSE, Representing pay attention to your finances; QUILL, Representing get back to the basics; RABBIT, Representing too much concern with sexual matters; RAINBOW, Representing the most difficult part of a situation is over; RAM, Representing a stubborn, aggressive person; RAT, Representing someone working against you behind your back; RING, Representing a marriage will take place, either romantic and business; ROOSTER, Representing an arrogant, boastful person you should not cross; ROSE, Representing romance is in the air; SCALES, Representing keep your life in balance; SCISSORS, Representing disappointment in some affair; SEA HORSE, Representing family matters; SHARK, Representing take care and there will be a loss of material wealth; SHIELD, Representing you need to defend yourself; SKULL, Representing hidden secrets can harm you; SPEAR, Representing heartache over what you no longer have; STAFF, Representing you will be taken care of in difficult times; STAR, Representing guaranteed success; STORK, Representing news of a birth and a new business opportunity; SUN, Representing happiness and well being; SUNRISE, Representing new creative ideas, New ventures, A fresh start; TABLE, Representing favorable period for you; TANKARD, Representing celebration, fun, enjoyment; TARGET, Representing goal oriented person; TEAPOT, Representing deep friendship with someone of the same sex; TEARDROPS, Representing great personal sorrow; TENT, Representing temporary situation; THRONE, Representing position of authority; TIGER, Representing doing something risky, Taking a chance; TORCH, Representing spiritual development, great enlightenment, awareness, understanding; TORTOISE, Representing slowly but surely getting ahead; TOWER, Representing solid foundation, Success with effort; TREE, Representing affairs with your family; TULIP, Representing great passion; TURKEY, Representing someone is behaving stupidly; UNICORN, Representing use your intuition to make beneficial changes; V, Representing victory in some endeavor; VALLEY, Representing deep personal strength and peace that assure success; VASE, Representing secret admirer; VINE, Representing you must seek out information that will help you; VULTURE, Representing beware of a person who wants something you have; WALL, Representing misunderstanding; WEDGE, Representing someone is trying to come between you and a friend and something you want; WEEPING WILLOW, Representing family sorrow; WELL, Representing family wishes come true; WHALE, Representing great worry over nothing; WHEEL, Representing indecisiveness, Allowing your life to flow instead of taking charge; WINDCHIMES, Representing peace and harmony; WISHBONE, Representing a wish is granted; WOMAN, Representing dealings and a relationship with a woman; WREATH, Representing sorrow over a loss; YOKE, Representing feeling tied down, frustrated; YOUNGER MAN, Representing dealings and relationship with a younger man; and YOUNGER WOMAN, Representing dealings and relationship with a younger woman.

8. The method of playing the fortune telling game as described in claim 7, wherein the at least one tea leaf fortune card further comprises decorative indicia on an opposite side of the card than the graphic symbols and correlating predictions.

9. The method of playing the fortune telling game as described in claim 6, wherein the at least one astral card is selected from a group of astral signs consisting of marriage, success, wealth, love, career and happiness.

10. The method of playing the fortune telling game as described in claim 9, wherein the at least one astral card has decorative indicia printed on an apposite side than the astral sign.

* * * * *